US009666033B2

(12) United States Patent
Lathrop

(10) Patent No.: US 9,666,033 B2
(45) Date of Patent: May 30, 2017

(54) ELECTRONIC SLOT MACHINE

(76) Inventor: Kenneth Lathrop, La Selva Beach, CA (US)

( * ) Notice: Subject to any disclaimer, the term of this patent is extended or adjusted under 35 U.S.C. 154(b) by 1259 days.

(21) Appl. No.: 11/581,190

(22) Filed: Oct. 14, 2006

(65) Prior Publication Data

US 2008/0090636 A1 Apr. 17, 2008

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/34* (2013.01); *G07F 17/32* (2013.01); *G07F 17/3204* (2013.01); *G07F 17/326* (2013.01); *G07F 17/3209* (2013.01); *G07F 17/3213* (2013.01); *G07F 17/3265* (2013.01)

(58) Field of Classification Search

CPC ..... G07F 17/34; G07F 17/32; G07F 17/3209; G07F 17/3211; G07F 17/3244; G07F 17/3265; G07F 17/3267; G07F 17/3202; G07F 17/3204; G07F 17/3213; G07F 17/326; G07F 17/3262

USPC ..... 463/20, 21, 16, 23, 36, 37; 273/292, 273/138.1, 139

See application file for complete search history.

(56) References Cited

U.S. PATENT DOCUMENTS

| | | | | |
|---|---|---|---|---|
| 4,200,291 | A * | 4/1980 | Hooker | 273/143 R |
| 6,413,162 | B1 * | 7/2002 | Baerlocher et al. | 463/20 |
| 6,641,477 | B1 * | 11/2003 | Dietz, II | 463/20 |
| 6,657,923 | B2 | 12/2003 | Laughlin | |
| 6,893,342 | B1 * | 5/2005 | Singer et al. | 463/20 |
| 6,908,381 | B2 * | 6/2005 | Ellis | 463/13 |
| 6,942,571 | B1 * | 9/2005 | McAllister et al. | 463/20 |
| 6,974,129 | B2 | 12/2005 | Nordman | |
| 7,001,274 | B2 | 2/2006 | Baerlocher | |
| 7,690,985 | B1 * | 4/2010 | Muskin et al. | 463/20 |
| 2003/0017868 | A1 | 1/2003 | Crawford | |
| 2004/0043812 | A1 * | 3/2004 | Ellis | 463/20 |
| 2004/0102245 | A1 | 5/2004 | Escalera | |
| 2005/0026678 | A1 | 2/2005 | Kaminkow | |
| 2005/0059454 | A1 * | 3/2005 | McComb et al. | 463/16 |
| 2005/0059455 | A1 | 3/2005 | Gerrard | |
| 2005/0059478 | A1 | 3/2005 | Peterson | |
| 2005/0288092 | A1 * | 12/2005 | Ellis | 463/20 |

(Continued)

FOREIGN PATENT DOCUMENTS

| | | |
|---|---|---|
| GB | 2098780 | 11/1982 |
| JP | 06238033 A * | 8/1994 |

(Continued)

*Primary Examiner* — William H McCulloch, Jr.
*Assistant Examiner* — Chase Leichliter
(74) *Attorney, Agent, or Firm* — Muskin & Farmer LLC

(57) ABSTRACT

An electronic slot machine, having a display for displaying a plurality of symbols arrayed in at least three vertical columns of symbols, and at least three horizontal rows of symbols where game play is initiated by selecting a sequence for sequentially spinning selected columns and rows up to three total. The resulting display of symbols are analyzed to determine whether the array of symbols constitute a winning combination. Additional game playing occurs when the player selects a new sequence of rows and columns for spinning to achieve a new set of symbols for analysis to determine a winning combination.

20 Claims, 27 Drawing Sheets

(56) References Cited

U.S. PATENT DOCUMENTS

| | | | |
|---|---|---|---|
| 2006/0019738 | A1 | 1/2006 | Baerlocher |
| 2006/0084498 | A1 | 4/2006 | Baerlocher |

FOREIGN PATENT DOCUMENTS

| | | |
|---|---|---|
| JP | 2003000859 | 1/2003 |
| WO | WO9303464 | 2/1993 |

* cited by examiner

ELECTRONIC SLOT MACHINE

FIELD OF THE INVENTION

The present invention relates to the field of electronic games of chance. More specifically, the present invention relates to an electronic slot machine displaying a plurality of symbols arrayed on at least three vertical columns intersecting at least three horizontal rows. The present invent provides additional opportunities to the user to create, improve, or even lose the arrayed set of symbols based upon the selection and sequential spinning of a combination of three columns and rows. This feature allows the user to incorporate strategy and build upon past results until a winning combination is reached.

BACKGROUND OF THE INVENTION

Over the years, a wide variety of games of chance have been devised to allow players to wager a sum of money for the opportunity to win greater sums of money. Such games include lotteries, bingo, keno, blackjack, poker, roulette, craps and slot machines. Of these games, many people find slot machines to be the most entertaining. For this reason, slot machines constitute a major source of profits for casinos.

It is of substantial value to a casino to encourage lengthier play sessions at a slot machine. When a player terminates play and walks away from a slot machine, that machine often goes unused for some period of time until a new player initiates play, thereby reducing revenue from that slot machine. Like any game of chance, the lengthier the play session, the larger the profit the casino stands to make. Casinos therefore constantly strive to increase the continuous playability time of slot machines.

In a basic mechanical slot machine, the player inserts a bill or coin and pulls down on the slot machine handle to initiate the game. Typically, three parallel, rotatable reels with an assortment of fruit, numbers, bars, or any other creative symbols are then caused to spin until each reel reaches a resting position. The success or failure of the game is determined by comparing the combination of reel symbols across a horizontal row with a table of winning combinations posted on the slot machine. To add interest to the game, the basic mechanical slot machine windows are frequently made large enough to show three adjacent symbols on each reel and thereby allow betting involving multiple rows. This betting can take the form, for example, of betting on the combinations formed across the upper horizontal row, middle horizontal row, lower horizontal row, and diagonal lines intersecting these rows.

With the advent of electronic technology, there have been many improvements to the mechanical slot machine. Among these improvements is the use of video monitors to display a simulation of three parallel, rotatable reels, rather than having three actual mechanical reels themselves. In operation, these electronic slot machines simulate the rotation of a physical reel, but typically select the final symbols through use of random numbers generated by a microprocessor rather than the physical rotation of a reel. In other words, the final symbols for each simulated reel in the electronic slot machine are randomly selected by the microprocessor and then displayed on the video monitor at the appropriate time and position.

The use of electronic technology for slot machines has allowed game designers to break free from the mechanical restrictions of earlier slot machines. For example, the number of combinations that can be displayed on a video monitor is no longer limited by the number of symbols that can be fit onto three physical reels. This opportunity for greater numbers of displayed combinations has led the way to greater jackpots and progressive slot machines. Also, with electronic technology, the three symbols shown in each column no longer need to correspond to three adjacent symbols on a physical reel. Through generation of different random numbers, each symbol displayed in a video monitor column can be independently generated, thereby decreasing the odds and inversely increasing the potential payout of any one game.

Nevertheless, both mechanical and electronic slot machines continue to suffer from several shared disadvantages. For example, one frequent frustration that players have with slot machines, even the new electronic slot machines, is that the initial spin of the slot machine does not allow the player to use strategy in selecting which columns and rows he wishes to spin and in what sequence, thereby increasing his probability of obtaining a winning combination. An additional frustration players face with mechanical and electronic slot machines is that the combination that is finally displayed along their betting line may fall just short of a winning combination and the player has no opportunity for adjusting the displayed combination.

It would be highly desirable to provide a slot machine, where a player is motivated, on a consistent and ongoing basis, to prolong session play by using strategy to sequentially select and spin columns and rows to build upon advantages gained in previous results.

SUMMARY OF THE INVENTION

The present invention is directed to an electronic slot machine that allows a player to use strategy in selecting a sequence for spinning a combination of columns and rows for a total of three. By sequentially spinning three columns and rows, the player has more control over the final results of the first game, and can better leverage his bets against the final outcome. The present invention enables the player to move symbols from one column or row to another creating favorable groupings of symbols. The present invention further enables the player to build upon the prior results of the first game in subsequent games, thereby giving him further control and leverage over the final outcome. The electronic slot machine in all its forms may be played on a slot machine kiosk, personal computer, or other device capable of accessing the internet.

The present invention further provides an electronic slot machine in which a plurality of symbols are arrayed along at least three vertical columns that intersect with at least three horizontal rows. In this way, both columns and rows form a grid and share at least nine symbols. The player begins play by selecting a sequence of columns and rows to spin totaling three. Shared symbols spin along a vertical axis and a horizontal axis. Shared symbols on unselected columns and rows remain unmoved.

More particularly, in an electronic gaming apparatus having a display for displaying a plurality of symbols arrayed in at least three vertical columns of symbols, and at least three horizontal rows of symbols, the present invention is directed to a method of playing a game comprising the steps of initiating game play by selecting a sequence for spinning columns and rows for a total of three, sequentially spinning the selected columns and rows, displaying a resulting set of symbols arrayed in the columns and rows on the display, and determining whether the resulting set of symbols constitutes a winning combination.

The present invention is also directed to a method of playing an electronic gaming apparatus comprising the steps of providing a display for displaying a plurality of symbols arrayed in at least two virtual reel sets, the first virtual reel set having at least three vertical columns of symbols, and the second virtual reel set having at least three horizontal rows of symbols, wherein the first vertical reel set and the second horizontal reel set intersect to form a three symbol by three symbol grid of at least nine shared symbols, initiating game play by selecting a sequence for spinning columns along a vertical axis and rows along a horizontal axis for a total of three, sequentially spinning the selected columns and rows, causing the shared symbols to spin along at least a vertical and a horizontal axis, without spinning the shared symbols on unselected columns and rows, displaying a resulting set of symbols arrayed in the columns and rows on the display, and determining whether the resulting set of symbols constitutes a winning combination.

The present invention is further directed to an electronic gaming apparatus comprising a display for displaying a plurality of symbols arrayed in at least three vertical columns of symbols and at least three horizontal rows of symbols, a memory which stores a list of symbols for each of the vertical columns and horizontal rows, a microprocessor connected to the memory and the display, and computer-executable instructions for allowing the player to initiate game play by selecting a sequence for spinning columns and rows for a total of three, sequentially spinning the selected columns and rows, displaying a resulting set of symbols arrayed in the columns and rows on the display, and determining whether the resulting set of symbols constitutes a winning combination.

The present invention is also directed to an electronic gaming apparatus comprising a display for displaying a plurality of symbols arrayed in at least two virtual reel sets, the first virtual reel set having at least three vertical columns of symbols and the second virtual reel set having at least three horizontal rows of symbols, wherein the first virtual reel set and the second virtual reel set intersect to form a three symbol by three symbol grid of at least nine shared symbols, a memory which stores a list of symbols for each of the vertical columns and horizontal rows, a microprocessor connected to the memory and the display, and computer-executable instructions for allowing the player to initiate game play by selecting a sequence for spinning columns and rows for a total of three, sequentially spinning the selected columns and rows, causing the shared symbols to spin along at least a vertical and a horizontal axis, without spinning the shared symbols on unselected columns and rows, displaying a resulting set of symbols arrayed in the columns and rows on the display, and determining whether the resulting set of symbols constitutes a winning combination.

In another embodiment, the present invention is directed to an electronic slot machine that allows a player to use strategy in selecting a sequence for spinning a combination of columns, rows and diagonal bands for a total of three. By sequentially spinning three columns, rows, and bands, the player has more control over the final results of the first game, and can better leverage his bets against the final outcome. The present invention enables the player to move symbols from one column, row, or band to another creating favorable groupings of symbols. As before, a player builds upon the prior results of the first game in subsequent games, thereby giving him further control and leverage over the final outcome.

In this embodiment, the present invention further provides an electronic slot machine in which a plurality of symbols are arrayed along at least three vertical columns that intersect with at least three horizontal rows and two diagonal bands. In this way, columns, rows, and bands form a grid and share at least five symbols. The player begins play by selecting a sequence of columns, rows and bands to spin totaling three. Shared symbols spin along a vertical axis, a horizontal axis, or a diagonal axis. Shared symbols on unselected columns and rows remain unmoved.

The present invention is directed to an electronic gaming apparatus having a display for displaying a plurality of symbols arrayed in at least three vertical columns of symbols, at least three horizontal rows of symbols, and at least two diagonal bands of symbols, a method of playing a game comprising the steps of initiating game play by selecting a sequence for spinning columns, rows, and bands for a total of three, sequentially spinning the selected columns, rows, and bands, displaying a resulting set of symbols arrayed in the columns, rows, and bands on the display, and determining whether the resulting set of symbols constitutes a winning combination.

The present invention is also directed to a method of playing an electronic gaming apparatus comprising the steps of providing a display for displaying a plurality of symbols arrayed in at least three virtual reel sets, the first virtual reel set having at least three vertical columns of symbols, the second virtual reel set having at least three horizontal rows of symbols, and the third virtual reel set having at least two diagonal bands of symbols, wherein the first vertical reel set, the second horizontal reel set, and the third diagonal reel set intersect to form a three symbol by three symbol grid of at least five shared symbols, initiating game play by selecting a sequence for spinning columns along a vertical axis, rows along a horizontal axis, and bands along a diagonal axis for a total of three, sequentially spinning the selected columns, rows, and bands, causing the shared symbols to spin along at least a vertical, a horizontal, and a diagonal axis, without spinning the shared symbols on unselected columns and rows, displaying a resulting set of symbols arrayed in the columns, rows, and bands on the display, and determining whether the resulting set of symbols constitutes a winning combination.

Still further, the present invention is directed to an electronic gaming apparatus comprising a display for displaying a plurality of symbols arrayed in at least three vertical columns of symbols, at least three horizontal rows of symbols, and at least two diagonal bands of symbols, a memory which stores a list of symbols for each of the vertical columns, horizontal rows, and diagonal bands, a microprocessor connected to the memory and the display, and computer-executable instructions for allowing the player to initiate game play by selecting a sequence for spinning columns, rows, and bands for a total of three; sequentially spinning the selected columns, rows, and bands, displaying a resulting set of symbols arrayed in the columns, rows, and bands on the display, and determining whether the resulting set of symbols constitutes a winning combination.

Yet further, the present invention is directed to an electronic gaming apparatus comprising a display for displaying a plurality of symbols arrayed in at least three virtual reel sets, the first virtual reel set having at least three vertical columns of symbols, the second virtual reel set having at least three horizontal rows of symbols, and the third virtual reel set having at least two diagonal bands of symbols, wherein the first virtual reel set, the second virtual reel set, and third virtual reel set intersect to form a three symbol by three symbol grid of at least five shared symbols, a memory which stores a list of symbols for each of the vertical columns, horizontal rows, and diagonal bands, a microprocessor connected to the memory and the display, and computer-executable instructions for allowing the player to initiate game play by selecting a sequence for spinning columns, rows, and bands for a total of three, sequentially spinning the selected columns, rows, and bands, causing the shared symbols to spin along at least a vertical, a horizontal, and a diagonal axis, without spinning the shared symbols on unselected columns, rows, and bands, displaying a resulting set of symbols arrayed in the columns, rows, and bands on the display, and determining whether the resulting set of symbols constitutes a winning combination.

DETAILED DESCRIPTION OF THE DRAWINGS

Figure 1:
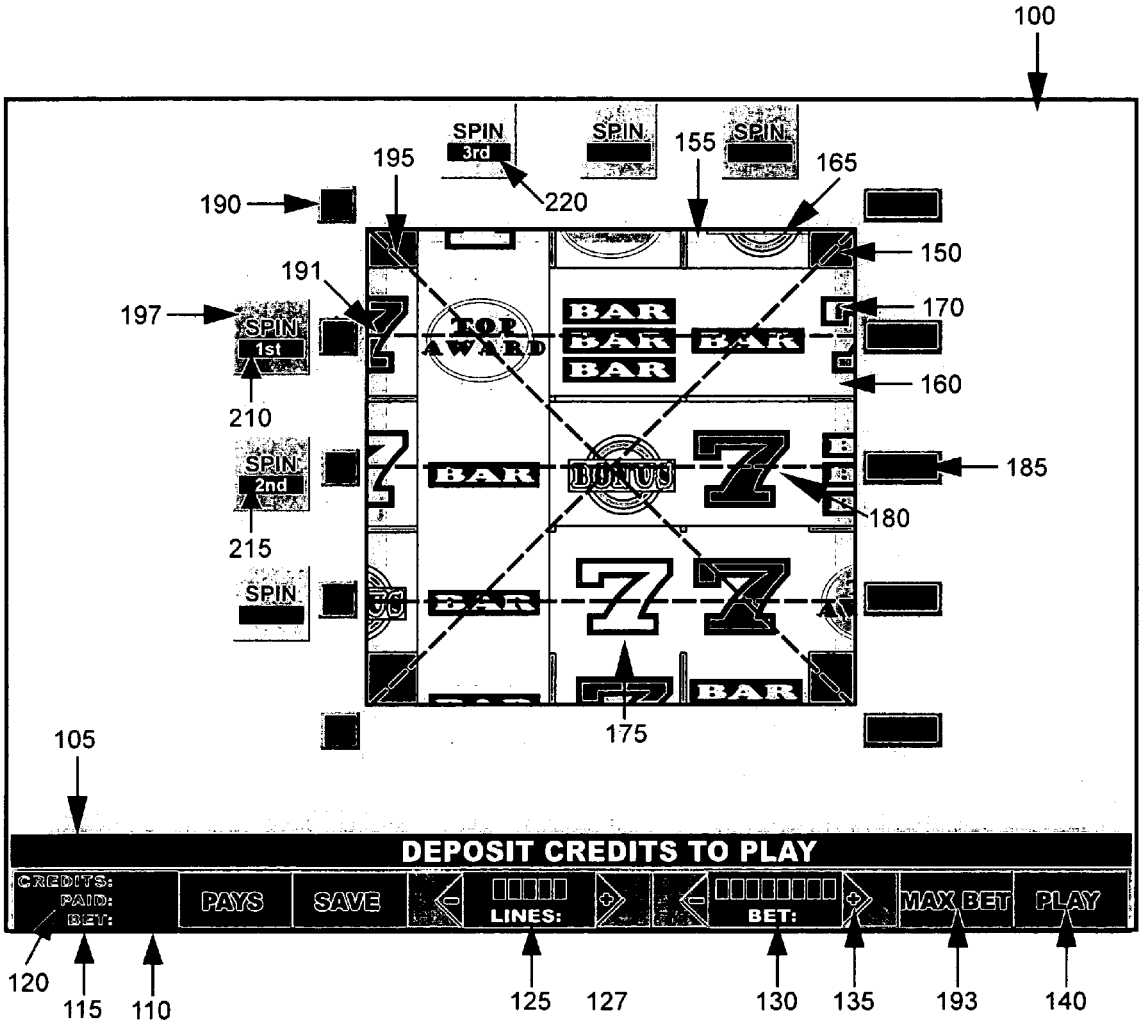
FIG. 1 shows a typical video screen display for the electronic slot machine.

The following is a detailed description of the presently preferred embodiments of the present electronic slot machine invention. However, the present invention is in no way intended to be limited to the embodiments discussed below or shown in the drawings. Rather, the description and the drawings are merely illustrative of the presently preferred embodiments of the invention.

It should be noted that the layout and interface presentation of video screen display 100, discussed in detail below, may vary depending upon the implementation choices of the operators of the electronic slot machine. For example, in one embodiment video screen display 100 may be a touch-screen. Alternatively, in another embodiment, the windows and keys on display 100 may be electrically connected switches that allow the player to set the parameters of his gaming experience. In this way, a wide variety of interfaces can be developed, based on market requirements to attract potential players.

FIG. 1 illustrates an embodiment of a video screen display 100 for the electronic slot machine. In the center of video screen 100 is play screen 150. Play screen 150 displays three vertical columns 155 and three horizontal rows 160. Vertical columns 155 are capable of virtually rotating along a vertical plane. Horizontal rows 160 are capable of virtually rotating along a horizontal plane. Columns 155 and rows 160 intersect to form a three symbol by three symbol grid 175 of at least nine shared symbols 180. Symbols 180 include numbers, wild cards, and various sets of bars. Various other symbols can be used, such as different types of fruit (e.g. cherries, plumbs, oranges, etc.), and non-fruit symbols such as bells, horseshoes, or other symbols of luck. To provide a more realistic appearance of a mechanical reel that has stopped while spinning, columns 155 display partial symbols 165 in the upper and lower periphery of display screen 150. Rows 160 display partial symbols 170 in the right and left periphery of display screen 150. In this manner, partial symbols 165 and 170 further add to the experience of a virtual electronic slot machine.

To the right of play screen 150 are payout windows 185. Payout windows 185 display a monetary amount when a game results in a winning combination. To the left of play screen 150 are line keys 190. Each line key 190 corresponds to one of five straight betting lines. The five straight betting lines include three horizontal lines 191, and two diagonal lines 195 that can be played to try and obtain a winning combination of symbols 180. Line keys 190 that are selected for play are illuminated with the bet amount 270. Alternatively, the player can select the "max bet" key 193 to select all five lines. When the max bet key 193 is selected, all line keys 190 illuminate and highlight the bet amount.

Above and to the left of play screen 150 are spin selection keys 197. Spin selection keys 197 indicate the sequence of up to three columns 155 and rows 160 the player has selected to spin. For example, if the player wishes to spin the first horizontal row, followed by the second horizontal row and conclude with the first vertical column, spin selection key 197 adjacent to first horizontal row 160 will indicate an illuminated "1$^{st}$" 210 representing the first spin selection, spin selection key 197 adjacent to second horizontal row 160 will indicate an illuminated "2$^{nd}$" 215 representing the second spin selection, and spin selection key 197 adjacent to first vertical column 155 will indicate an illuminated "3$^{rd}$" 220 representing the third spin selection.

Below play screen 150 is message board 105. Message board 105 is used to display instructions to the player during the course of the game and prompt a response such as, "Deposit Credits to Play" and "Pick Three Reels to Spin in Sequence." Message board 105 is also used to provide words of encouragement to the player such as "Good Luck!" or the results of the game after the final spin, such as "Winner!!!! $25,000" or "Try Again."

Below message board 105 are a series of keys that allow the player to set the parameters of each individual game. For example, tracker key 110 keeps a current and accurate account of the dollar amount bet by the player in the current game 115 and a total of the amount that has been paid out to the player in the current game 120. Adjacent to tracker key 110 is line selector key 125. Line selector key 125 allows the player to select the number of horizontal lines 191 or diagonal lines 195 the player wishes to bet on. The number of lines selected can be increased or decreased using adjustment keys 127 on either side of selector 125. Alternatively, as previously discussed, the player can select the max bet key 193 to select all five lines. Max bet key 193 is adjacent to bet selector key 130 on video screen 100. Bet selector key 130 allows the user to set the dollar amount of his bet. The dollar amount can be increased or decreased by dollar adjustment keys 135 on either side of selector key 130. Lastly, adjacent to max bet key 193 is play key 140. Play selection key 140 is responsible for initiating game play.

When the player decides to play the electronic slot machine, video screen 100 displays the outcome of the last game played on the machine. Message board 105 prompts the player to "Deposit Credits to Play." In response, the player would insert credits, whether in the form of tokens, money, or credit card information to begin play. Using bet selector key 130 and adjustment keys 135, the player first selects the dollar amount of the bet he wishes to place on each straight line 191, 195. Next, using line selector key 125 and adjustment keys 127, the player first selects the number of lines he wishes to play. Then, using line keys 190, the player selects which of the five line options he wishes to place his wager on. At this time, message board 105 prompts the player to select the max bet key 193. If the player chooses the max bet option, all five line keys 190 would illuminate with the dollar amount of the bet placed on each line. If the player declines the max bet offer and instead selects specific lines, only the selected lines would illuminate with the bet amount. The player next selects play key 140 to start the proposition.

Figure 2:
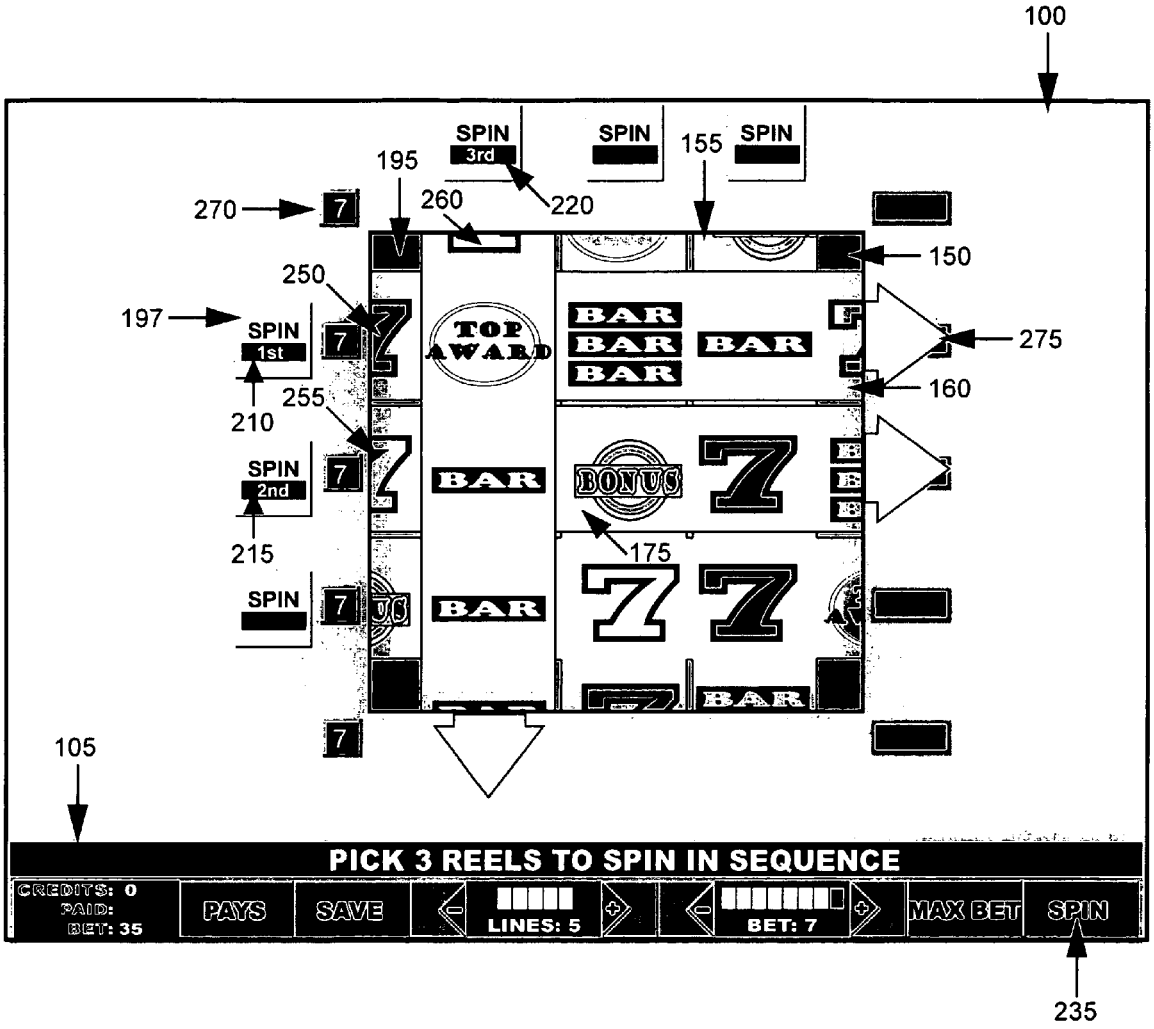
FIG. 2 shows a video screen display for the electronic slot machine after the wager for each line, the play lines, and the play key has been selected.

FIG. 2 shows video screen display 100 for the electronic slot machine after the play key 140 has been selected to start the proposition. Once play key 140 has been selected, it converts into spin key 235. The individual columns 155 and rows 160 become interactive as the player is prompted by message board 105 to "Pick Three Reels to Spin in Sequence." In response, the player picks three spin selection keys 197 representing three columns 155 or rows 160 to spin in sequence. As discussed above, when spin selection keys 197 are selected, each will indicate the sequence of columns 155 and rows 160 the player wishes to spin—a "1$^{st}$" 210 represents the first selected column or row 250, a "2$^{nd}$" 215 represents the second sequentially selected column or row 255, and a "3$^{rd}$" 220 represents the third and final sequentially selected column or row 260. The player next selects spin key 235 to commence sequential spinning of the selected columns and rows 250, 255, and 260. Arrows 275 appear adjacent to selected columns or rows 250, 255, and 260 to indicate the direction of the virtual rotation along vertical and horizontal planes.

Figure 3:
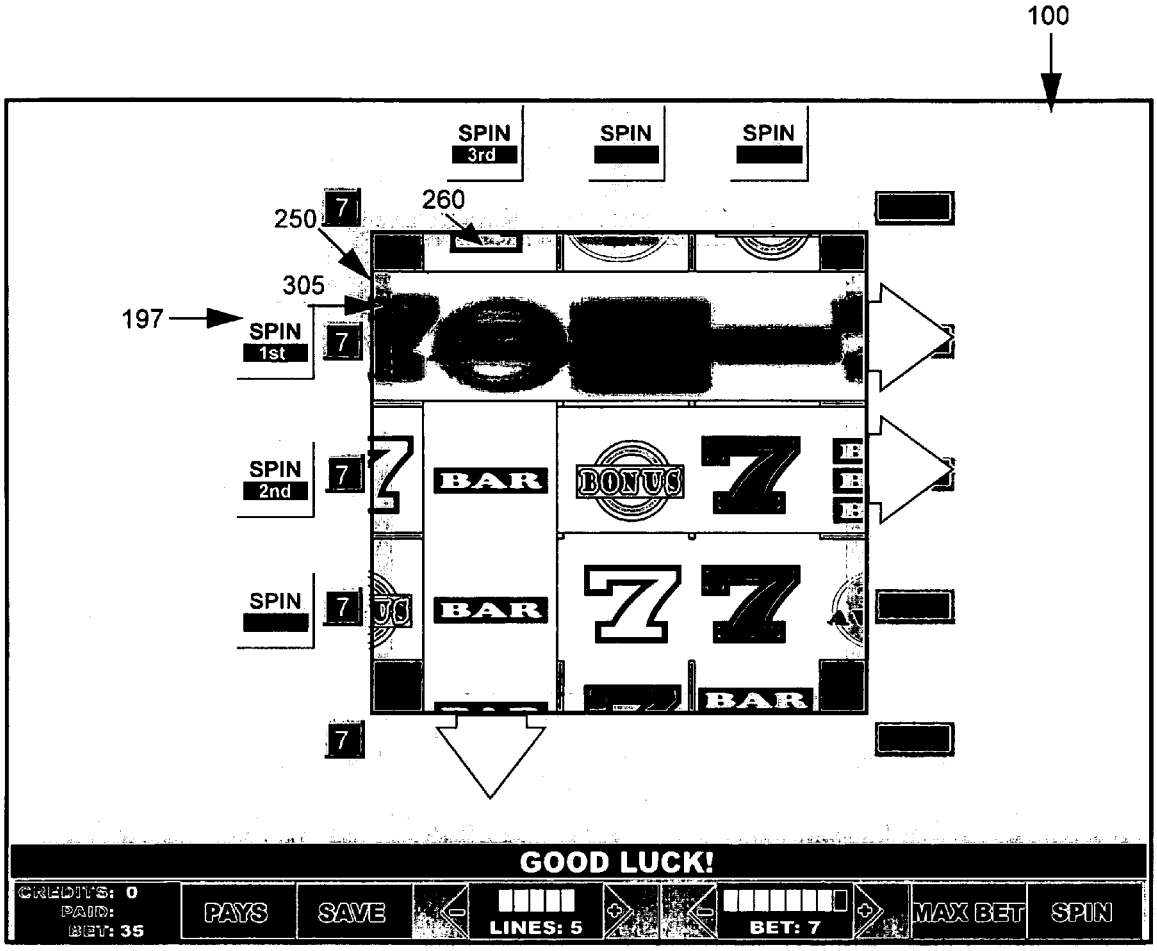
FIG. 3 shows a video screen display for the electronic slot machine with the first horizontal row selection virtually spinning.

FIG. 3 shows video screen display 100 for the electronic slot machine after spin key 235 has caused first selected row 250 to virtually "spin.". In the preferred embodiment, visually, the spinning of the first selected column or row 250 replicates a mechanical slot machine so that spinning symbols 305 on the first selected spinning column or row 250 are blurry and difficult to recognize. To further recreate the experience of a mechanical slot machine, selected column or row 250 gradually slows down before it comes to a stop displaying an array of new symbols 180.

Figure 4:
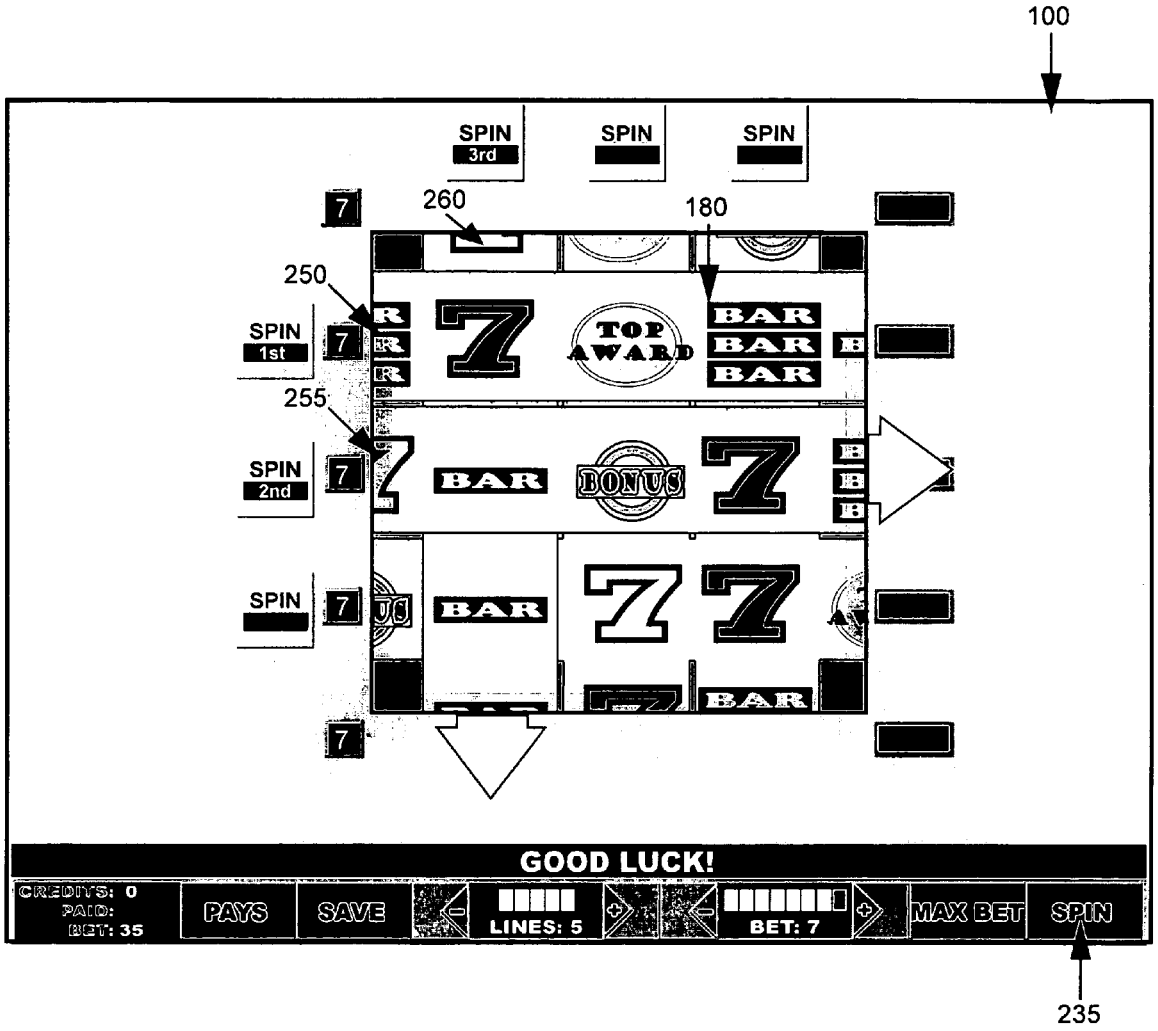
FIG. 4 shows a video screen display for the electronic slot machine after the first horizontal row selection completed its spin.

FIG. 4 shows video screen display 100 for the electronic slot machine after first selected horizontal row 250 completed its virtual spin and temporarily displays a new array of symbols 180. In this instance, first horizontal row 250 has arrayed three different symbols 180. Thereafter, the next sequentially selected row, horizontal row 255 highlights and prepares to spin.

Figure 5:
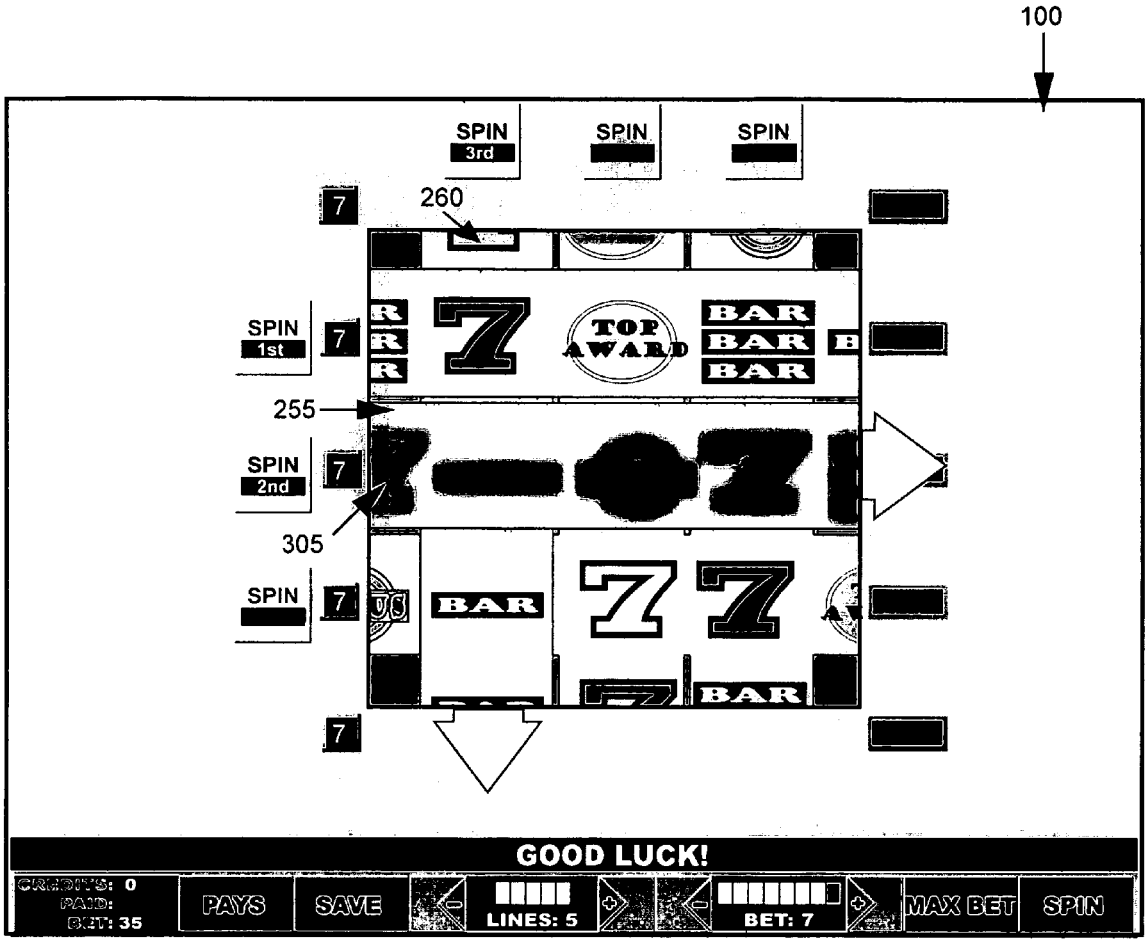
FIG. 5 shows video screen display for the electronic slot machine with the second horizontal row selection virtually spinning.

FIG. 5 shows video screen display 100 for the electronic slot machine after the second sequentially selected horizontal row 255 commences its virtual spin. As before, the spinning of row 255 replicates a mechanical slot machine so that spinning symbols 305 on row 255 are blurry and difficult to recognize. To further recreate the experience of a mechanical slot machine, selected row 255 gradually slows down before it comes to a stop.

Figure 6:
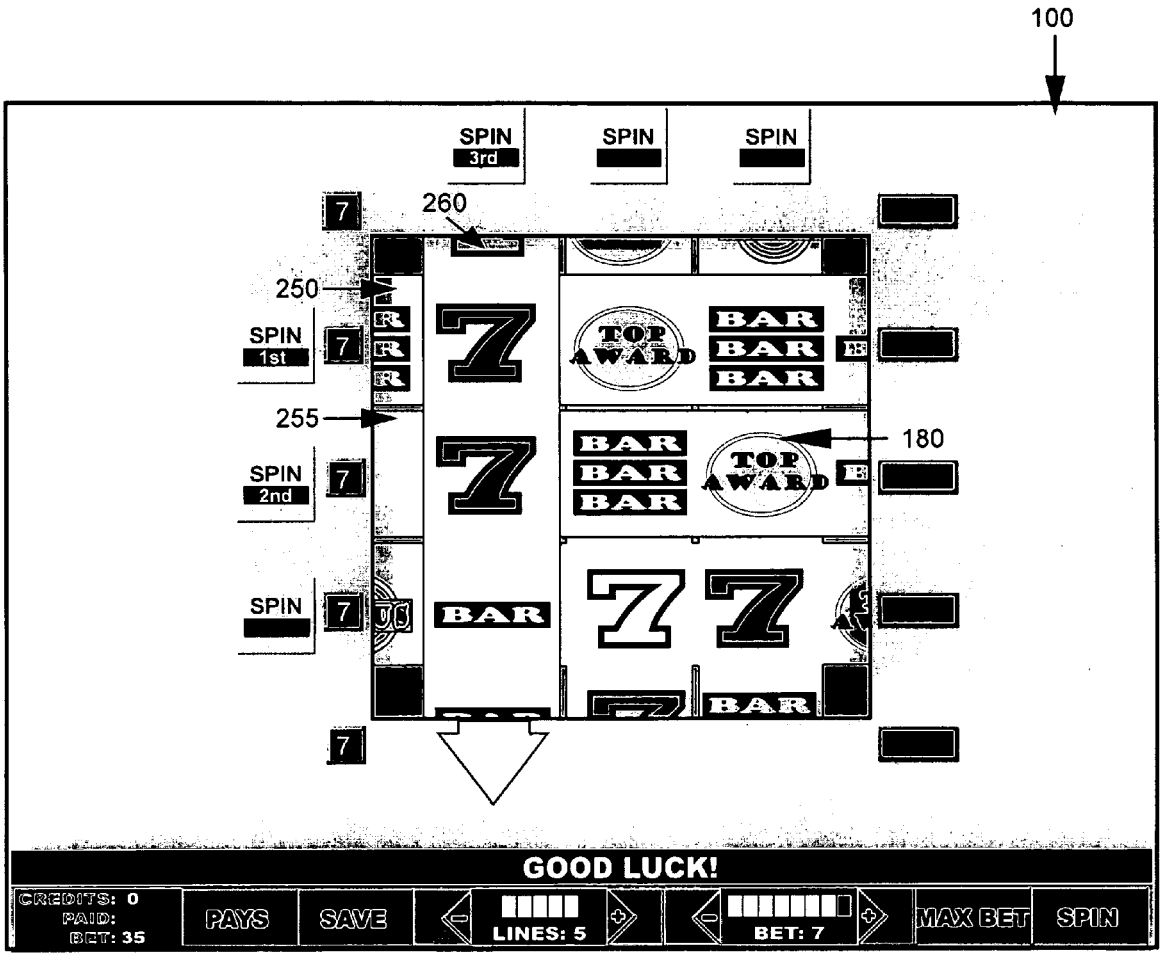
FIG. 6 shows a video screen display for the electronic slot machine after the second horizontal row selection completed its spin.

FIG. 6 shows video screen display 100 for the electronic slot machine after second selected horizontal row 255 completed its virtual spin and temporarily displays a new array of symbols 180. In this instance, second horizontal row 255 has arrayed three different symbols 180. Thereafter, the next sequentially selected column, vertical column 260 highlights and prepares to spin.

Figure 7:
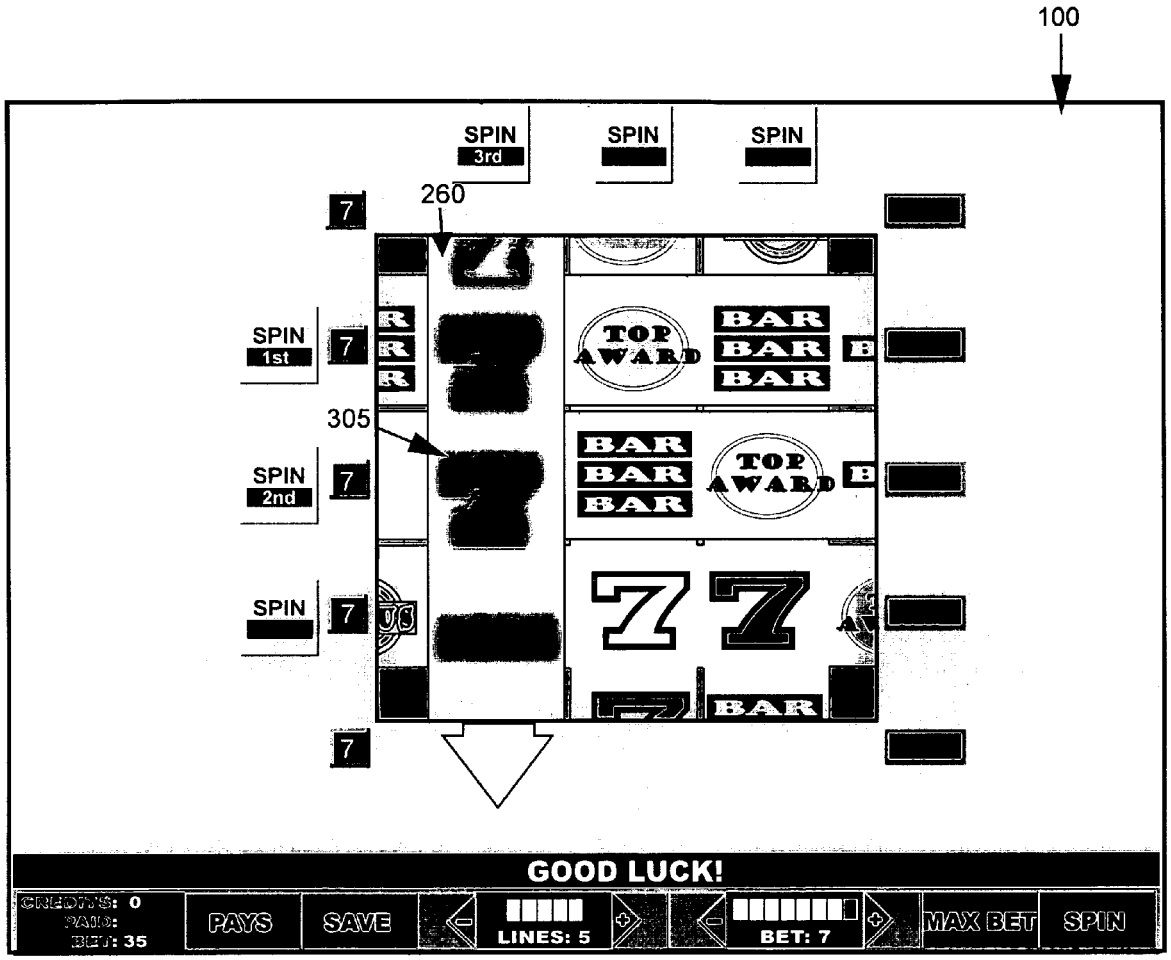
FIG. 7 shows video screen display for the electronic slot machine with the third vertical column selection virtually spinning.

FIG. 7 shows video screen display 100 for the electronic slot machine after the third sequentially selected vertical column 260 commences its virtual spin. As before, the spinning of column 260 replicates a mechanical slot machine so that spinning symbols 305 on column 260 are blurry and difficult to recognize. To further recreate the experience of a mechanical slot machine, selected column 260 gradually slows down before it comes to a stop.

Figure 8:
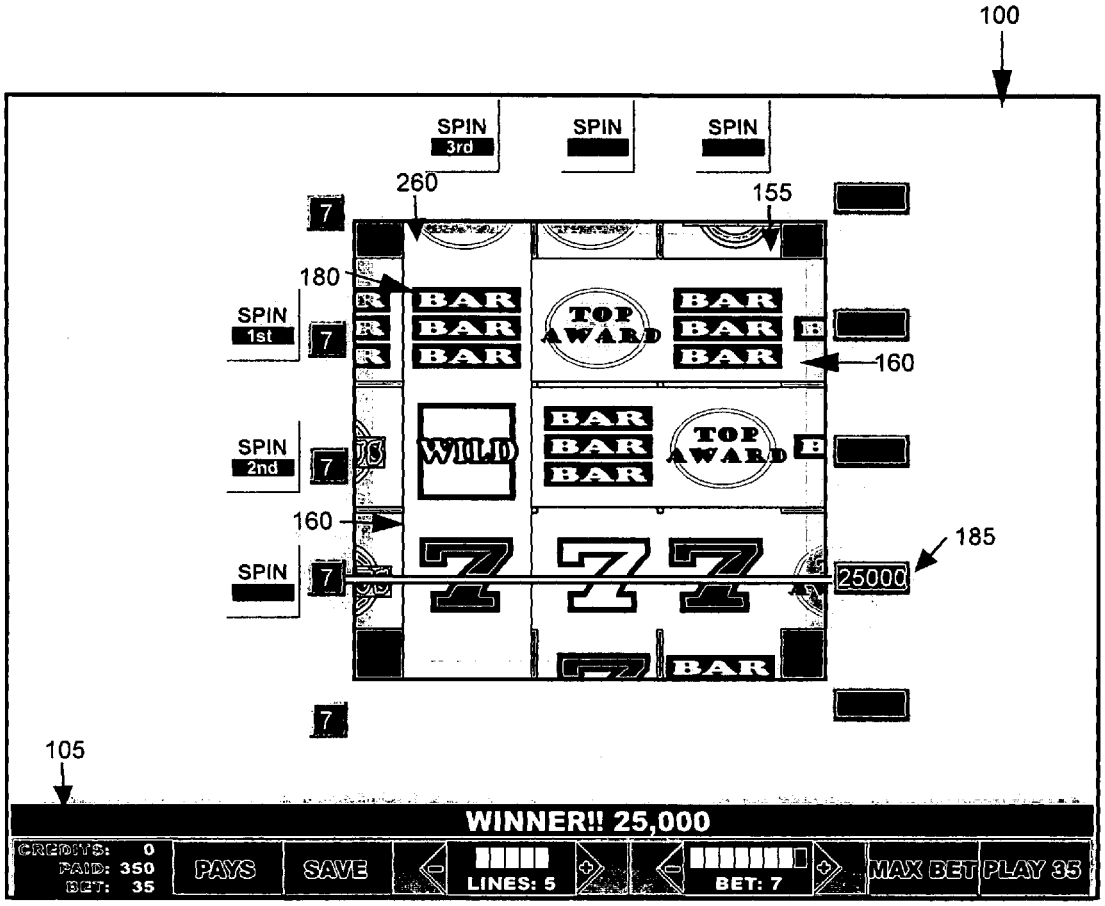
FIG. 8 shows a video screen display for the electronic slot machine after the third and final vertical column selection completed its spin.

FIG. 8 shows video screen display 100 for the electronic slot machine after third selected vertical column 260 completed its virtual spin and displays a new array of symbols 180. In this instance the third horizontal row 160 has produced a successful array of symbols (three "7"s) and therefore message board 105 displays a congratulatory message indicating that the player has won the game. Message board 105 also indicates the monetary amount of the win, which is further displayed in payout window 185. The player now has the option to either continue playing by selecting his line(s) and coin bets and then selecting new columns 155 or rows 160 he wishes to spin as discussed in detail above, or cash out and terminate the experience. It is believed that since the player has the ability to build on his previous results, he will opt to continue play and take advantage of his last hand.

Figure 9:
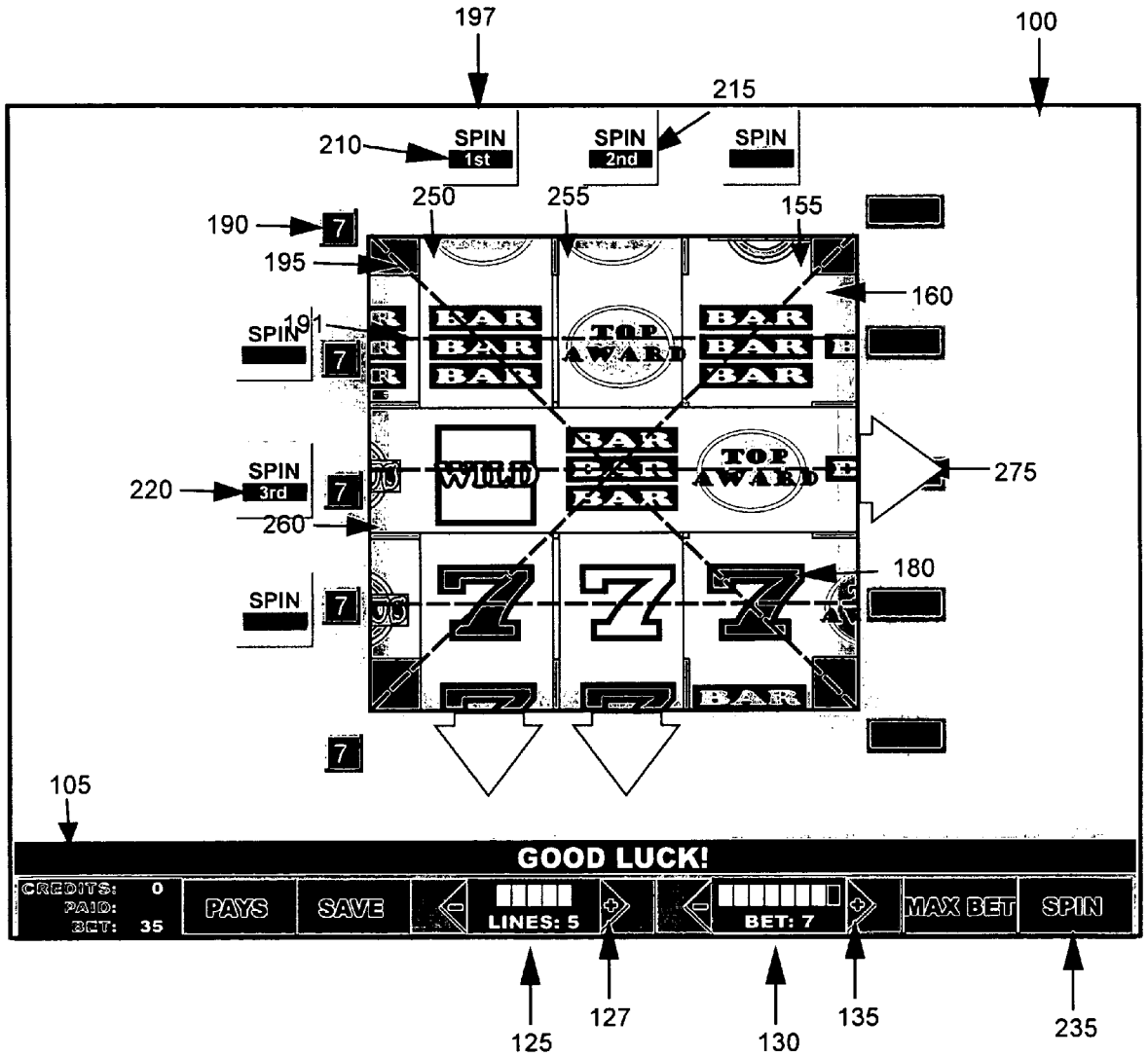
FIG. 9 shows video screen display for the electronic slot machine after the third and final display where the player has opted to continue play.

FIG. 9 shows video screen display 100 for the electronic slot machine after the third and final display of symbols 180 where the player has opted to continue play and take advantage of his last hand. Message board 105 provides the player with words of encouragement, "Good Luck!" As before, using bet selector key 130 and adjustment keys 135, the player selects the dollar amount of the bet he wishes to place on each straight line 191, 195. Next, using line selector key 125 and adjustment keys 127, the player selects the number of lines he wishes to play. Then, using line keys 190, the player selects which of the five line options he wishes to place his wager on. The player next selects spin key 235 to recommence the proposition.

As before individual columns 155 and rows 160 become interactive. The player selects three spin selection keys 197 representing three columns 155 or rows 160 to spin in sequence. As before when spin selection keys 197 are selected, each will indicate the sequence of columns 155 and rows 160 the player wishes to spin. A "$1^{st}$" 210 represents the first selected vertical column 250, a "$2^{nd}$" 215 represents the second sequentially selected column 255, and a "$3^{rd}$" 220 represents the third and final sequentially selected row 260. The player next selects spin key 235 to commence sequential spinning of the selected columns and rows 250, 255, and 260. Arrows 275 appear adjacent to selected columns or rows 250, 255, and 260 to indicate the direction of the virtual rotation along vertical and horizontal planes. This process may be repeated as many times as necessary until the player achieves his objectives.

Figure 10:
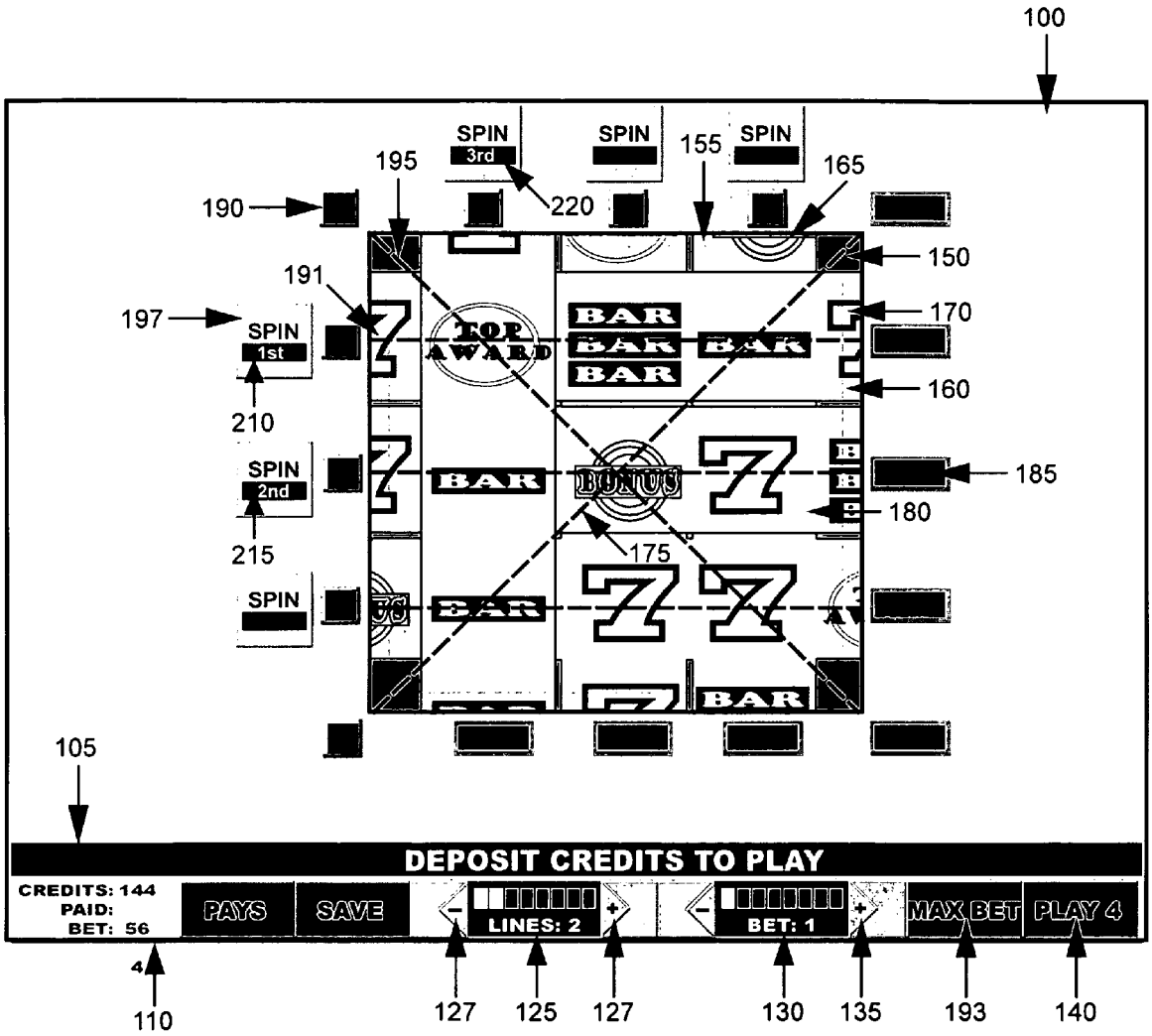
FIG. 10 is a numeric representation of a preferred embodiment of the present invention.

FIG. 10 is a numeric representation of a preferred embodiment of the present invention. Grid 400 is a numeric representation of play screen 150 in the initial stage of play, when the player first approaches the slot machine. Grid 400 is comprised of a vertical reel set 404 which comprises three vertical columns 405, 406, and 407. Grid 400 is also comprised of a horizontal reel set 409 which comprises three horizontal rows 410, 411, and 412. Columns 405, 406, and 407 and rows 410, 411, and 412 intersect to form a three symbol by three symbol grid 400 of at least nine shared symbols 415. Symbols 415 in grid 400 are shown as "bar(s)" and "blank(s)" but may be any character or figure created by the game designer.

Each vertical column corresponds to a vertical reel strip, so that column 405 corresponds to vertical reel strip 420, column 406 corresponds to vertical reel strip 421, and column 407 corresponds to vertical reel strip 422. Strips 420, 421, and 422 contain spots 425 that correspond to a particular symbol 430. In the preferred embodiment, strips 420, 421, and 422 contain ten spots 425. However, the present invention is in no way limited to a fixed number of spots. In fact, electronic and computer technology has enabled the game designer to create thousands or millions of spots 425 on each strip. After a random spin, the shared symbols 415 that appear on grid 400, and are visible to the player, correlate to a random selection of three sequential spots on a strip (See FIG. 11).

Each horizontal row corresponds to a horizontal reel strip, so that row 410 corresponds to horizontal reel strip 435, row 411 corresponds to horizontal reel strip 436, and row 412 corresponds to horizontal reel strip 437. Strips 435, 436, and 437 contain spots 440 that correspond to a particular symbol 430. In the preferred embodiment, strips 435, 436, and 437 contain ten spots 440. However, as before, the present invention is in no way limited to a fixed number of spots. After a random spin, the shared symbols 415 that appear on grid 400, and are visible to the player, correlate to a random selection of three sequential spots on a strip.

Figure 11:
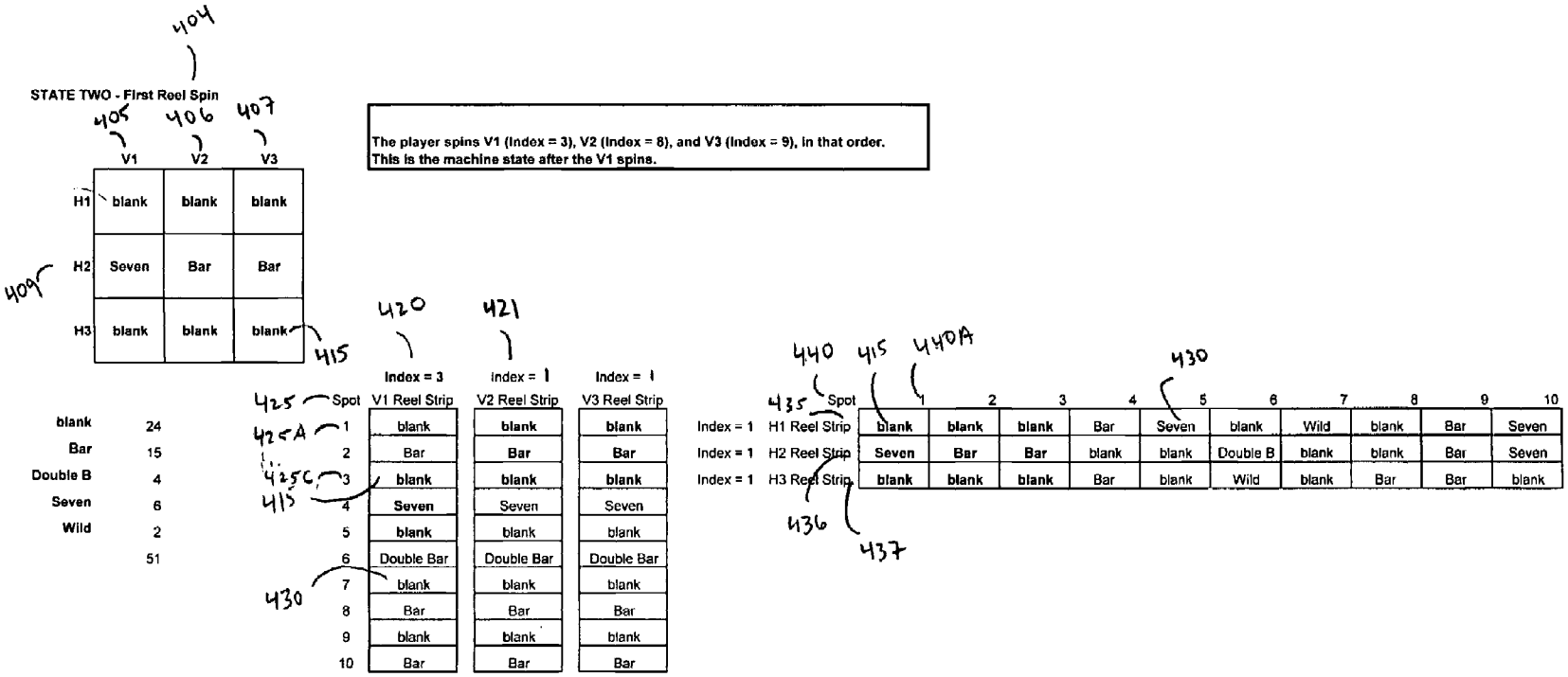
FIG. 11 is a numeric representation of a preferred embodiment of the present invention after the first vertical column selection completed its spin.
Figure 12:
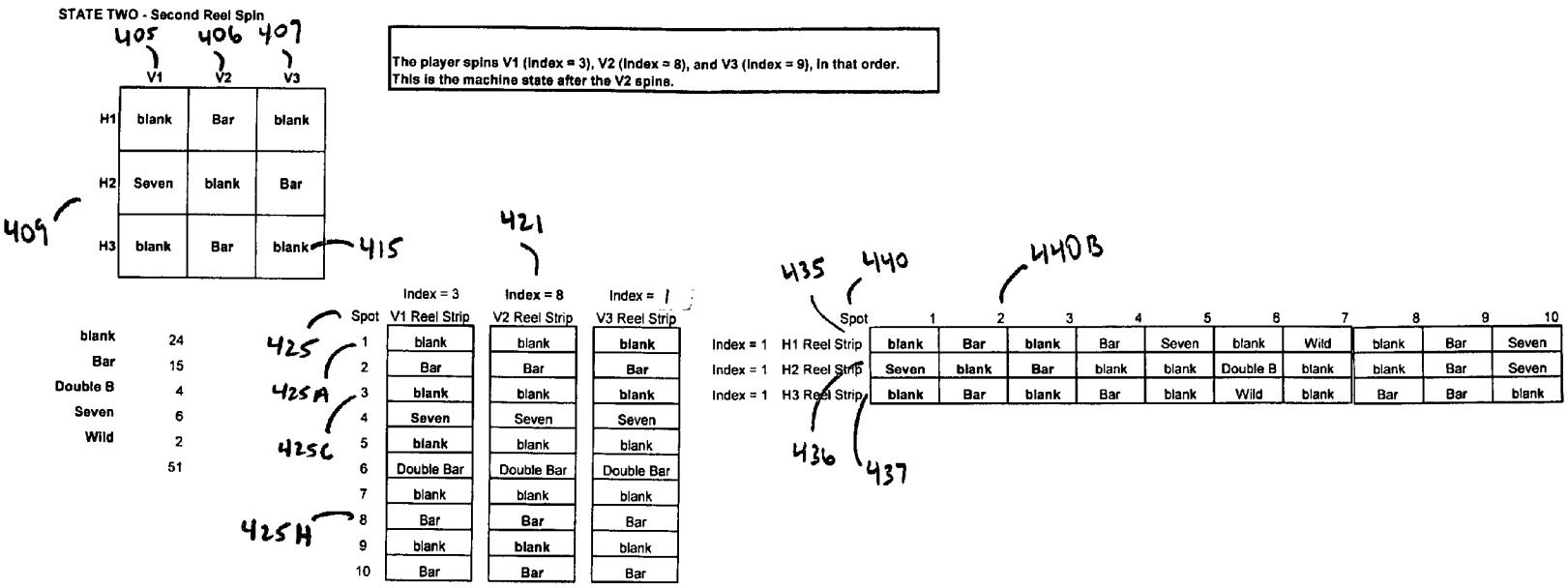
FIG. 12 is a numeric representation of a preferred embodiment of the present invention after the second vertical column selection completed its spin.
Figure 13:
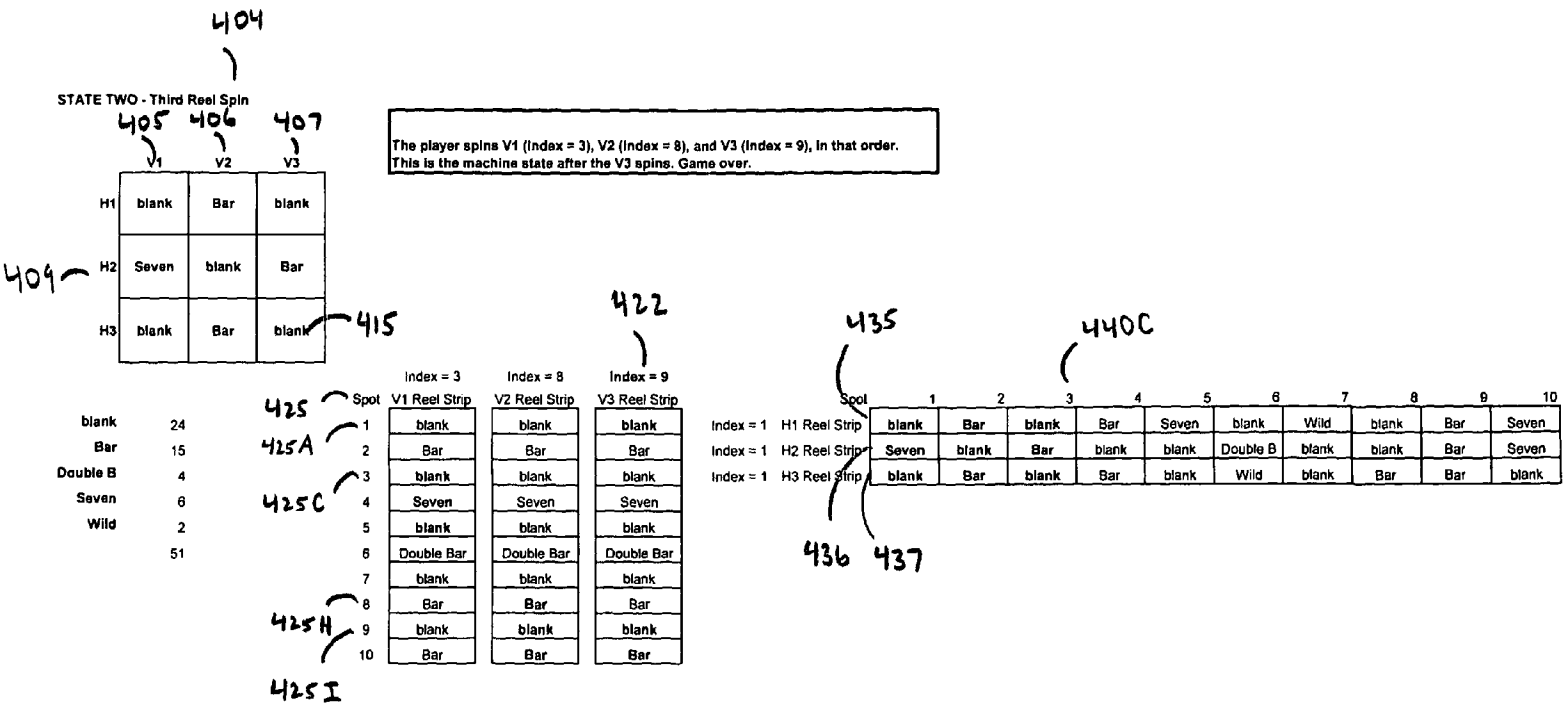
FIG. 13 is a numeric representation of a preferred embodiment of the present invention after the third and final vertical column selection completed its spin.

FIGS. 11-13 illustrate a numerical representation of FIG. 10 once the player has sequentially selected to virtually spin the first column 405 (FIG. 11), followed by the second column 406 (FIG. 12), and finally the third column 407 (FIG. 13). FIG. 11 shows strip 420 after the first column 405 has completed the first sequentially selected virtual "spin" and temporarily displays a new array of symbols 415. The result of a random virtual spin of strip 420 has caused the shared symbol 415 from spot one 425A in FIG. 10 to "move" to spot three 425C in FIG. 11 to become the new first shared symbol 415 in strip 420 corresponding to column 405. Incidentally, since both vertical reel set 404 and horizontal reel set 409 intersect, this vertical move has also caused a change of symbols on spot one 440A for horizontal strips 435, 436, and 437.

FIG. 12 shows strip 421 after the second column 406 has completed the second sequentially selected virtual "spin" and temporarily displays a new array of symbols 415. The result of a random virtual spin of strip 421 has caused the shared symbol 415 from spot one 425A in FIG. 10 to "move" to spot eight 425H in FIG. 12 to become the new first shared symbol 415 in strip 421 corresponding to column 406. Again, since both vertical reel set 404 and horizontal reel set 409 intersect, this vertical move has also caused a change of symbols on spot two 440B for horizontal strips 435, 436, and 437.

FIG. 13 shows strip 422 after the third column 407 has completed the third sequentially selected virtual "spin" and displays a new array of symbols 415. The result of a random virtual spin of strip 422 has caused the shared symbol 415 from spot one 425A in FIG. 10 to "move" to spot nine 425I in FIG. 13 to become the new first shared symbol 415 in strip 422 corresponding to column 407. Since both vertical reel set 404 and horizontal reel set 409 intersect, this vertical move has also caused a change of symbols on spot three 440C for horizontal strips 435, 436, and 437.

Figure 14:
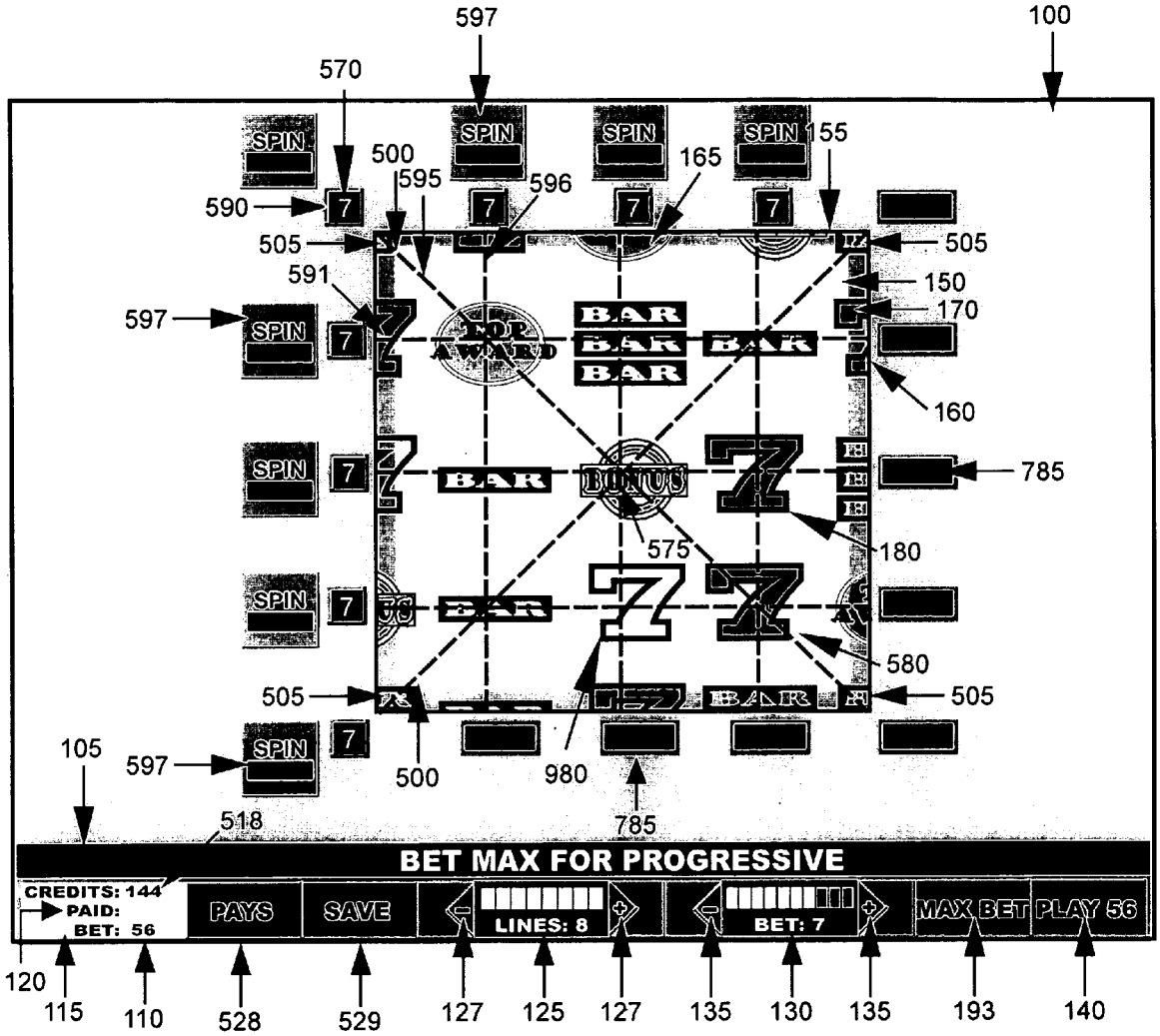
FIG. 14 shows a typical video screen display for an alternate embodiment of the electronic slot machine.

FIG. 14 shows an alternative embodiment of the present invention that optionally permits a further layer of complexity and strategy to the electronic slot machine. In the center of video screen 100 is play screen 150. However, in addition to the existing three vertical columns 155 and three horizontal rows 160, play screen 150 displays an electronic slot machine with two diagonal bands 500. Where vertical columns 155 virtually rotate along a vertical plane and horizontal rows 160 rotate along a horizontal plane, bands 500 are capable of virtually rotating along a diagonal plane. Columns 155, rows 160, and bands 500 intersect to form a three symbol by three symbol grid 575 of at least nine symbols 180, of which five symbols 580 are shared by at least one column 155, row, 160 and band 500, and four symbols 980 are shared by at least one column 155 and one row 160. As previously mentioned, symbols 180, 580 and 980 can take the form of any design or character. To provide a more realistic appearance of a mechanical reel that has stopped while spinning, columns 155 display partial symbols 165 in the upper and lower periphery of display screen 150. Rows 160 display partial symbols 170 in the right and left periphery of display screen 150. Diagonal bands 500 display partial symbols 505 in the upper and lower corners of display screen 150. In this manner, partial symbols 165, 170, and 505 further add to the experience of a virtual electronic slot machine.

This alternative embodiment incorporates by reference all the numerous layout and interface features of the horizontal-vertical embodiment discussed above. For example, to the right of play screen 150 and below pay screen 150 are payout windows 785. Payout windows 785 display a monetary amount when a game results in a winning combination. To the left of play screen 150 are line keys 590. Each line key 590 corresponds to one of eight straight betting lines. The eight straight betting lines include three horizontal lines 591, two diagonal lines 595, and three vertical lines 596 that can be played to try and obtain a winning combination of symbols 180. Line keys 590 that are selected for play are illuminated with the bet amount 570. Alternatively, the player can select the "max bet" key 193 to select all eight lines. When the max bet key 193 is selected, all line keys 590 illuminate and highlight the bet amount.

Above play screen 150 and to the left of play screen 150 are spin selection keys 597. Spin selection keys 597 indicate the sequence of up to three columns 155, rows 160, and bands 500 the player has selected to spin. For example, if the player wishes to spin the first vertical column, followed by the first horizontal row and conclude with the right diagonal band, spin selection key 597 adjacent to first vertical row 160 will indicate an illuminated "$1^{st}$" 610 representing the first spin selection, spin selection key 597 adjacent to first horizontal row 160 will indicate an illuminated "$2^{nd}$" 615 representing the second spin selection, and spin selection key 597 adjacent the right diagonal band 500 will indicate an illuminated "$3^{rd}$" 620 representing the third spin selection.

Below play screen 150 is message board 105. As before, message board 105 is used to display instructions to the player during the course of the game and prompt a response such as, "Deposit Credits to Play" and "Pick Three Reels to Spin in Sequence." Message board 105 is also used to provide words of encouragement to the player such as "Good Luck!" or the results of the game after the final spin, such as "Winner!!!! $25,000" or "Try Again."

Below message board 105 are a series of keys that allow the player to set the parameters of each individual game. For example, tracker key 110 keeps a current and accurate account of the dollar amount bet by the player in the current game 115, a running total of the amount that has been paid out to the player in all previous games 120, and a running total of credits earned by the player 518. Adjacent to tracker key 110 is pays key 528. The selection of pays key 528 will provide the player with a table or graphic listing the various payouts for various successful combinations of symbols. For example, three successive "7's" will result in payout of $1,000, or three successive "single bars" will result in a payout of $900. In this manner, the player can use pays key 528 to develop a strategy and focus the selection of columns 155, rows 160, or bands 500 to spin on achieving the highest payout possible.

Adjacent to pay key 528 is save key 529. The selection of save key 529 will cause the electronic slot machine to save the last game played by the player in memory so that a player can resume play after an interval and build upon the results of the last game played. Save key 529 is ideally suited for casinos and other gaming institutions where a large number of players successively play on any given machine and where numerous other forms of entertainment such as shows, restaurants, and the like are available for the player to take a break.

Adjacent to save key 529 is line selector key 125. Line selector key 125 allows the player to select the number of horizontal lines 591, vertical lines 596, or diagonal lines 595 the player wishes to bet on. The number of lines selected can be increased or decreased using adjustment keys 127 on either side of selector 125. Alternatively, as previously discussed, the player can select the max bet key 193 to select all eight lines. Max bet key 193 is adjacent to bet selector key 130 on video screen 100. Bet selector key 130 allows the user to set the dollar amount of his bet. The dollar amount can be increased or decreased by dollar adjustment keys 135 on either side of selector key 130. Lastly, adjacent to max bet key 193 is play key 140. Play selection key 140 is responsible for initiating game play.

When the player decides to play this embodiment of the electronic slot machine, video screen 100 displays the outcome of the last game played on the machine. Message board 105 prompts the player to "Deposit Credits to Play." In response, the player would insert credits, whether in the form of tokens, money, or credit card information to begin play. Using bet selector key 130 and adjustment keys 135, the player first selects the dollar amount of the bet he wishes to place on each straight line 591, 595, and 596. Next, using line selector key 125 and adjustment keys 127, the player first selects the number of lines he wishes to play. Then, using line keys 590, the player selects which of the eight line options he wishes to place his wager on. At this time, message board 105 prompts the player to select the max bet key 193. If the player chooses the max bet option, all eight line keys 590 would illuminate with the dollar amount of the bet placed on each line. If the player declines the max bet offer and instead selects specific lines, only the selected lines would illuminate with the bet amount. The player next selects play key 140 to start the proposition.

Figure 15:
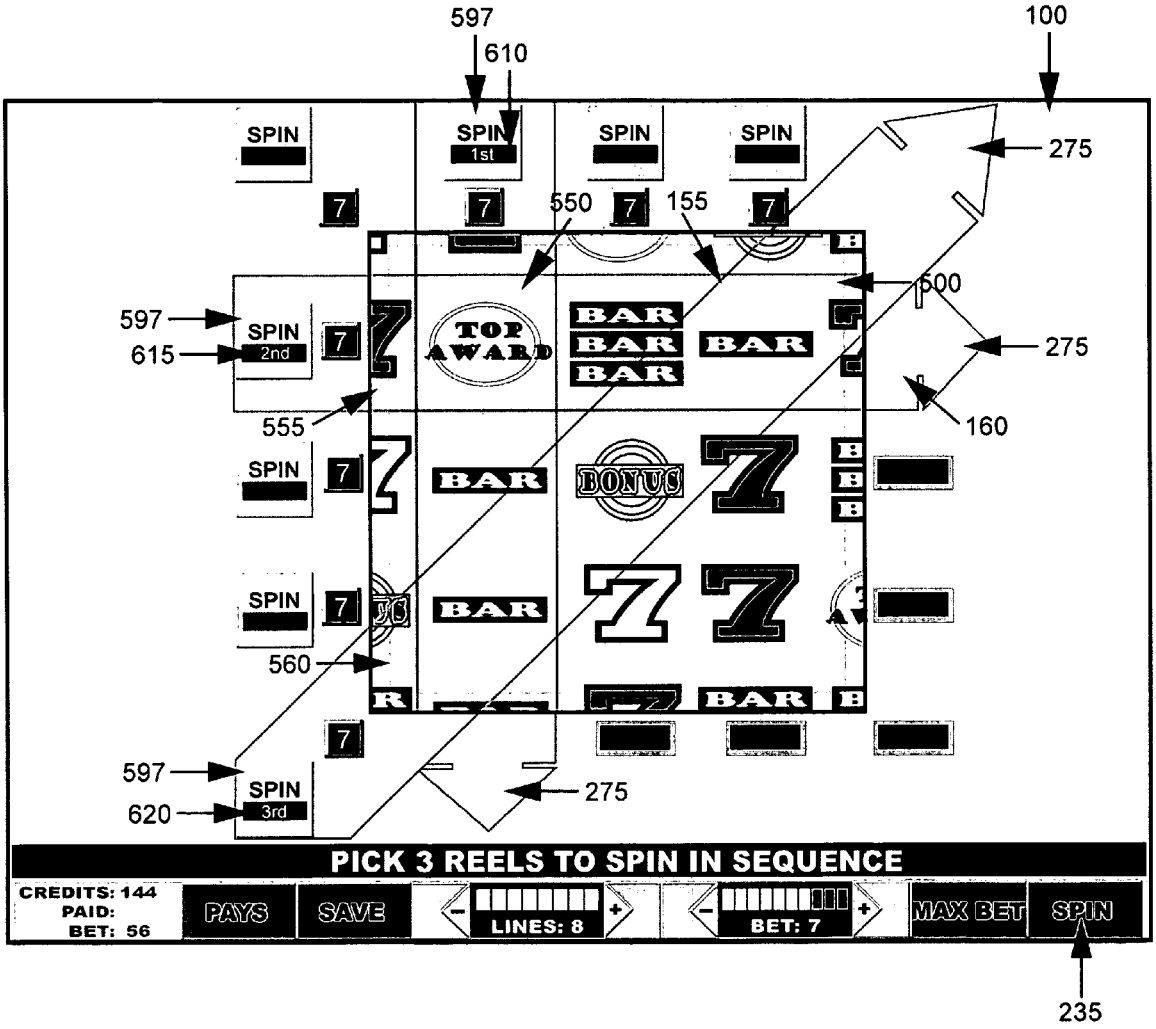
FIG. 15 shows a video screen display for an alternate embodiment of the electronic slot machine after the wager for each line, the play lines, and the play key has been selected.

This embodiment of the present invention operates in the same manner as the horizontal-vertical embodiment discussed in detail above. FIG. 15 shows video screen display 100 for the electronic slot machine after the play key 140 has been selected to start the proposition. As before, once play key 140 has been selected, it converts into spin key 235. The individual columns 155, rows 160, and bands 500 become interactive as the player is prompted by message board 105 to "Pick Three Reels to Spin in Sequence." In response, the player picks three spin selection keys 597 representing three columns 155, rows 160, and bands 500 to spin in sequence. As discussed above, when spin selection keys 597 are selected, each will indicate the sequence of columns 155, rows 160, and bands 500 the player wishes to spin—a "$1^{st}$" 610 represents the first selected column, row, or band 550, a "$2^{nd}$," 615 represents the second sequentially selected column, row, or band 555, and a "$3^{rd}$," 620 represents the third and final sequentially selected column or row 560. The player next selects spin key 235 to commence sequential spinning of the selected columns, rows, and bands 550, 555, and 560. Arrows 275 appear adjacent to selected columns, rows, and bands 550, 555, and 560 to indicate the direction of the virtual rotation along vertical and horizontal planes.

Figure 16:
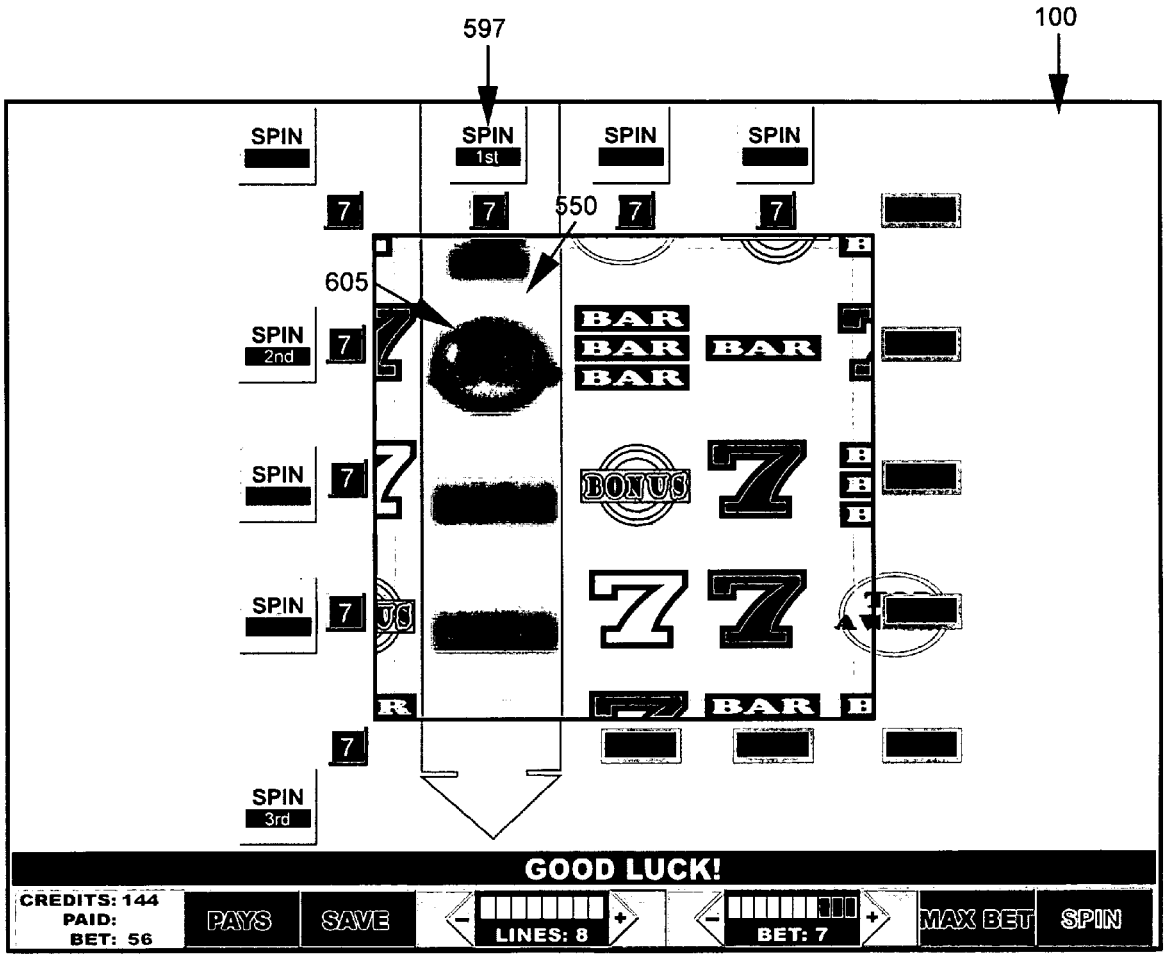
FIG. 16 shows a video screen display for an alternate embodiment of the electronic slot machine with the first vertical column selection virtually spinning.

FIG. 16 shows video screen display 100 for the electronic slot machine after spin key 597 has caused first selected column 550 to virtually "spin." As before, in the preferred embodiment, visually, the spinning of the first selected column, row, or band 550 replicates a mechanical slot machine so that spinning symbols 605 on the first selected spinning column, row, or band 550 are blurry and difficult to recognize. To further recreate the experience of a mechanical slot machine, selected column, row, or band 550 gradually slows down before it comes to a stop displaying an array of new symbols 180.

Figure 17:
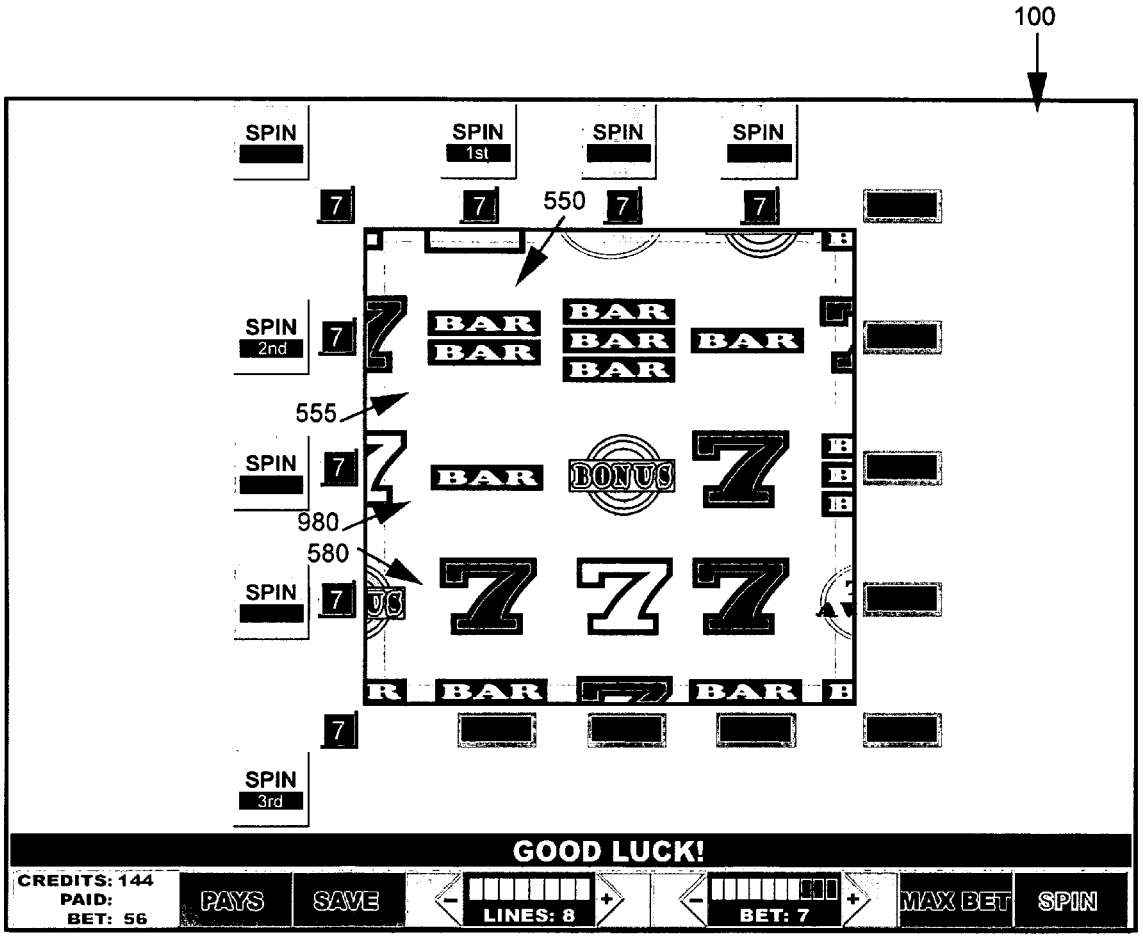
FIG. 17 shows a video screen display for an alternate embodiment of the electronic slot machine after the first vertical column selection completed its spin.

FIG. 17 shows video screen display 100 for the electronic slot machine after first selected vertical column 550 completed its virtual spin and temporarily displays a new array of symbols 580 and 980. In this instance, first vertical column 550 has arrayed three different symbols 580 and 980. Thereafter, the next sequentially selected horizontal row 555 highlights and prepares to spin.

Figure 18:
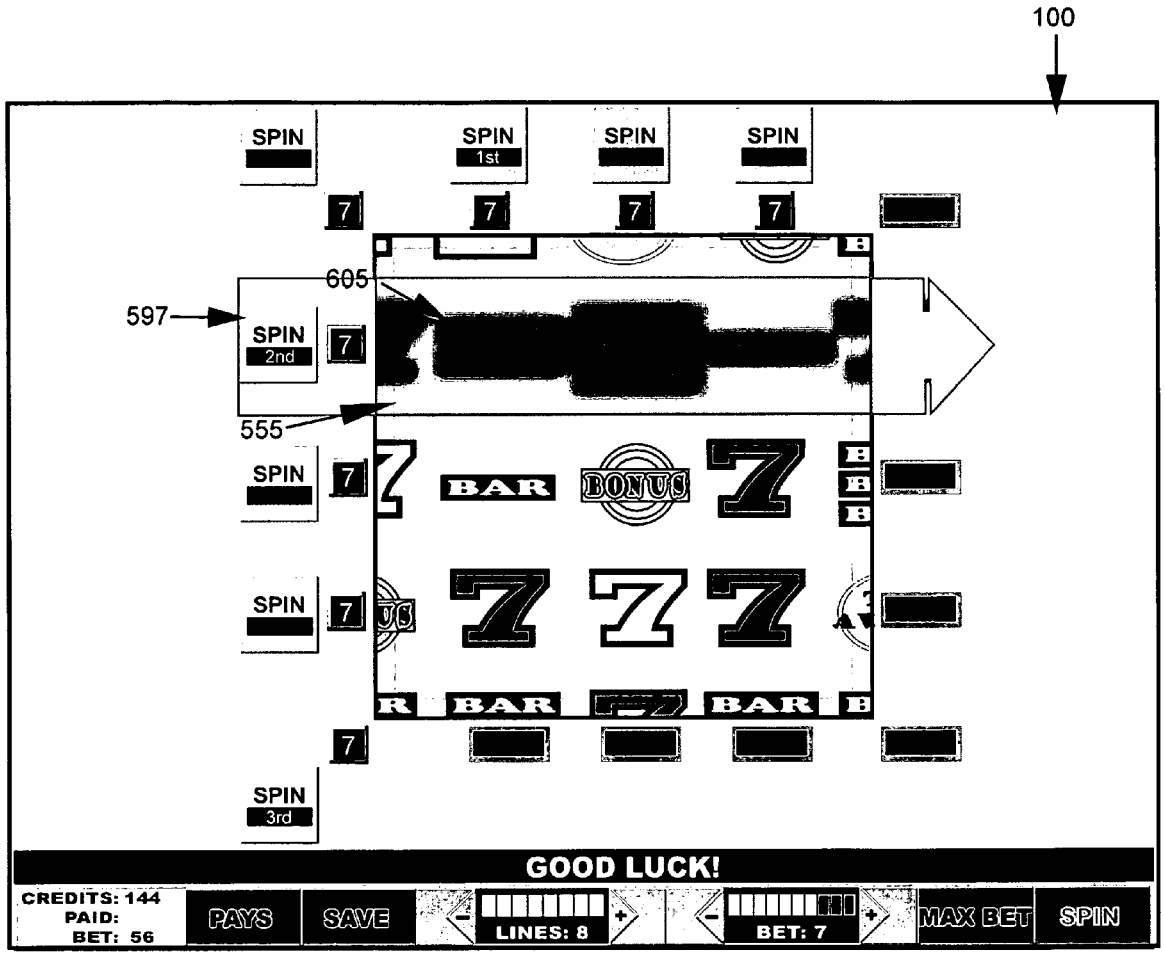
FIG. 18 shows video screen display for an alternate embodiment of the electronic slot machine with the first horizontal row selection virtually spinning.

FIG. 18 shows video screen display 100 for the electronic slot machine after the second sequentially selected horizontal row 555 commences its virtual spin. As before, the spinning of selected row 555 replicates a mechanical slot machine so that spinning symbols 605 on row 555 are blurry and difficult to recognize. To further recreate the experience of a mechanical slot machine, selected row 555 gradually slows down before it comes to a stop.

Figure 19:
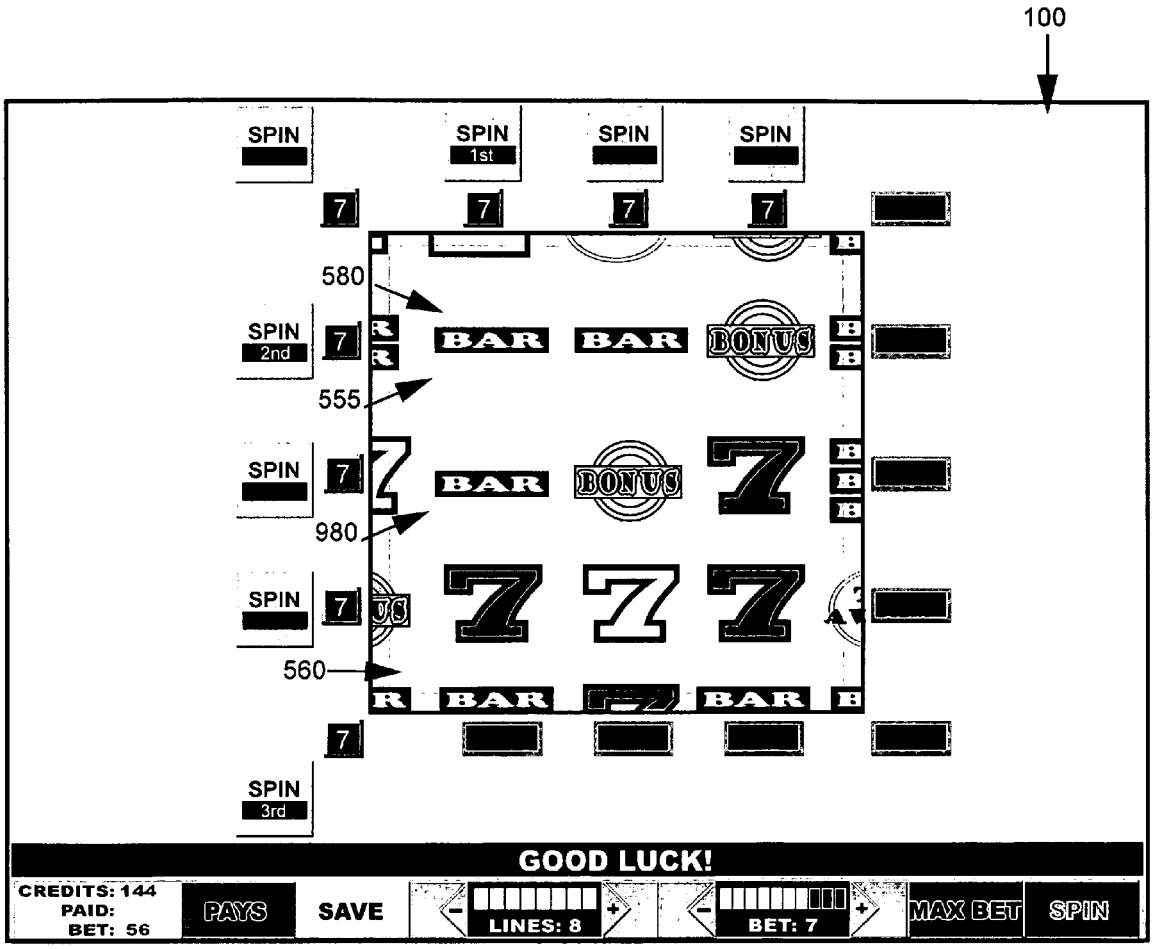
FIG. 19 shows a video screen display for an alternate embodiment of the electronic slot machine after the first horizontal row selection completed its spin.

FIG. 19 shows video screen display 100 for the electronic slot machine after second selected horizontal row 555 completed its virtual spin and temporarily displays a new array of symbols 580 and 980. In this instance, second horizontal row 555 has arrayed three different symbols 580 and 980. Thereafter, the next sequentially selected diagonal band 560 highlights and prepares to spin.

Figure 20:
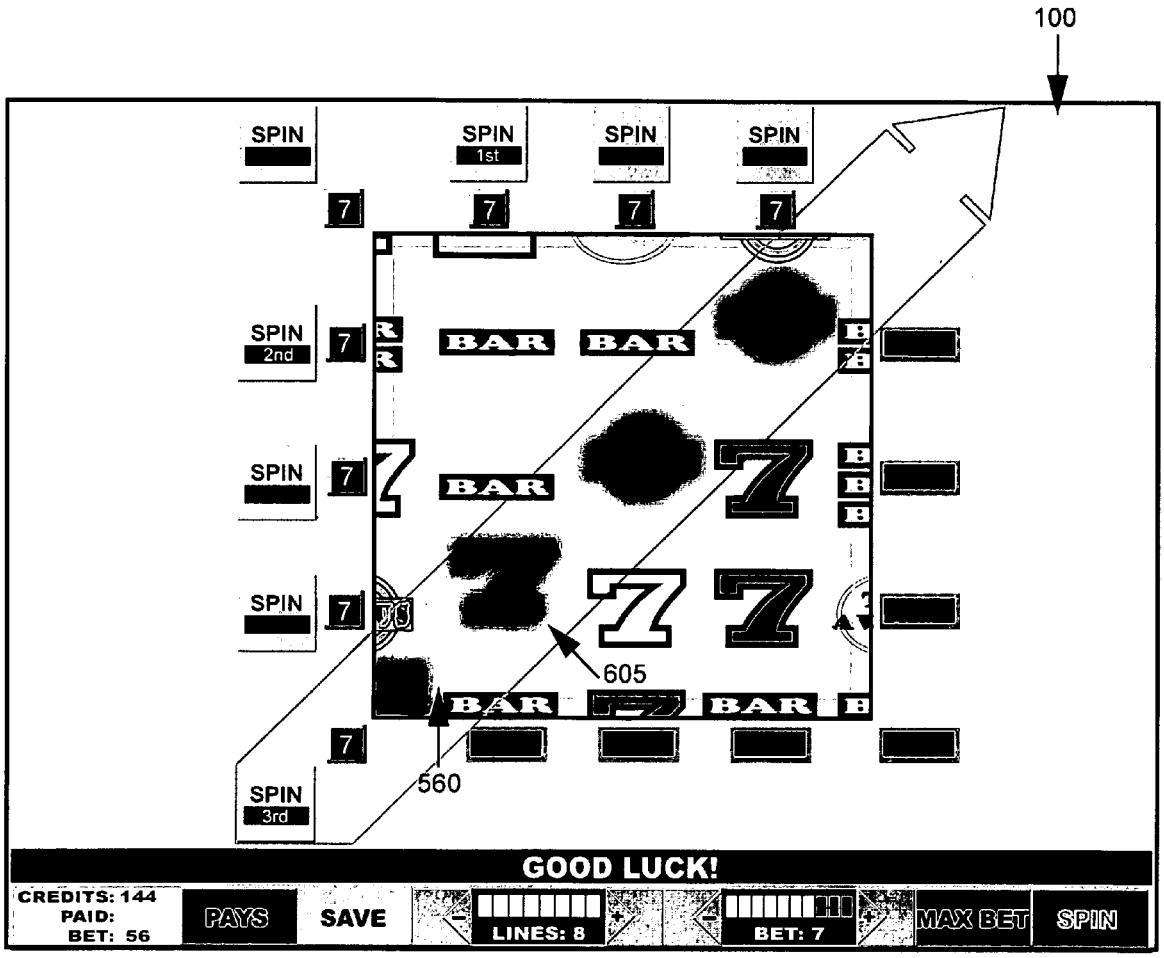
FIG. 20 shows video screen display for an alternate embodiment of the electronic slot machine with the second diagonal band selection virtually spinning.

FIG. 20 shows video screen display 100 for the electronic slot machine after the third sequentially selected diagonal band 560 commences its virtual spin. As before, the spinning of band 560 replicates a mechanical slot machine so that spinning symbols 605 on band 560 are blurry and difficult to recognize. To further recreate the experience of a mechanical slot machine, selected band 560 gradually slows down before it comes to a stop.

Figure 21:
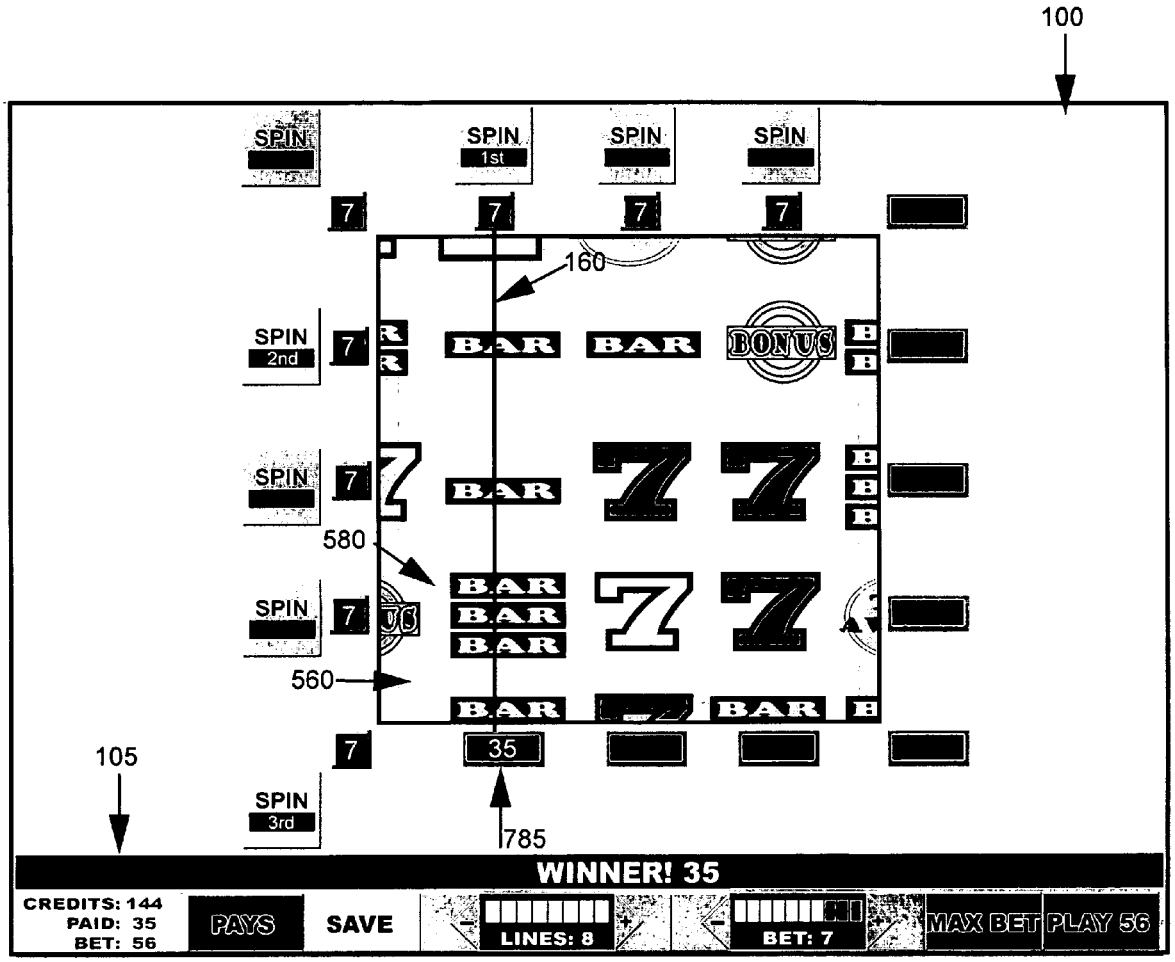
FIG. 21 shows a video screen display for an alternate embodiment of the electronic slot machine after the second and final diagonal band selection completed its spin.

FIG. 21 shows video screen display 100 for the electronic slot machine after third selected vertical column 560 completed its virtual spin and displays a new array of symbols 580. In this instance the first vertical column 160 has produced a successful array of symbols (three bars) and therefore message board 105 displays a congratulatory message indicating that the player has won the game. Message board 105 also indicates the monetary amount of the win, which is further displayed in payout window 785. The player now has the option to either continue playing by selecting his line(s) and coin bets and then selecting new columns 155, rows 160, or bands 500 he wishes to spin as discussed in detail above, or cash out and terminate the experience. It is believed that since the player has the ability to build on his previous results, he will opt to continue play and take advantage of his last hand.

Figure 22:
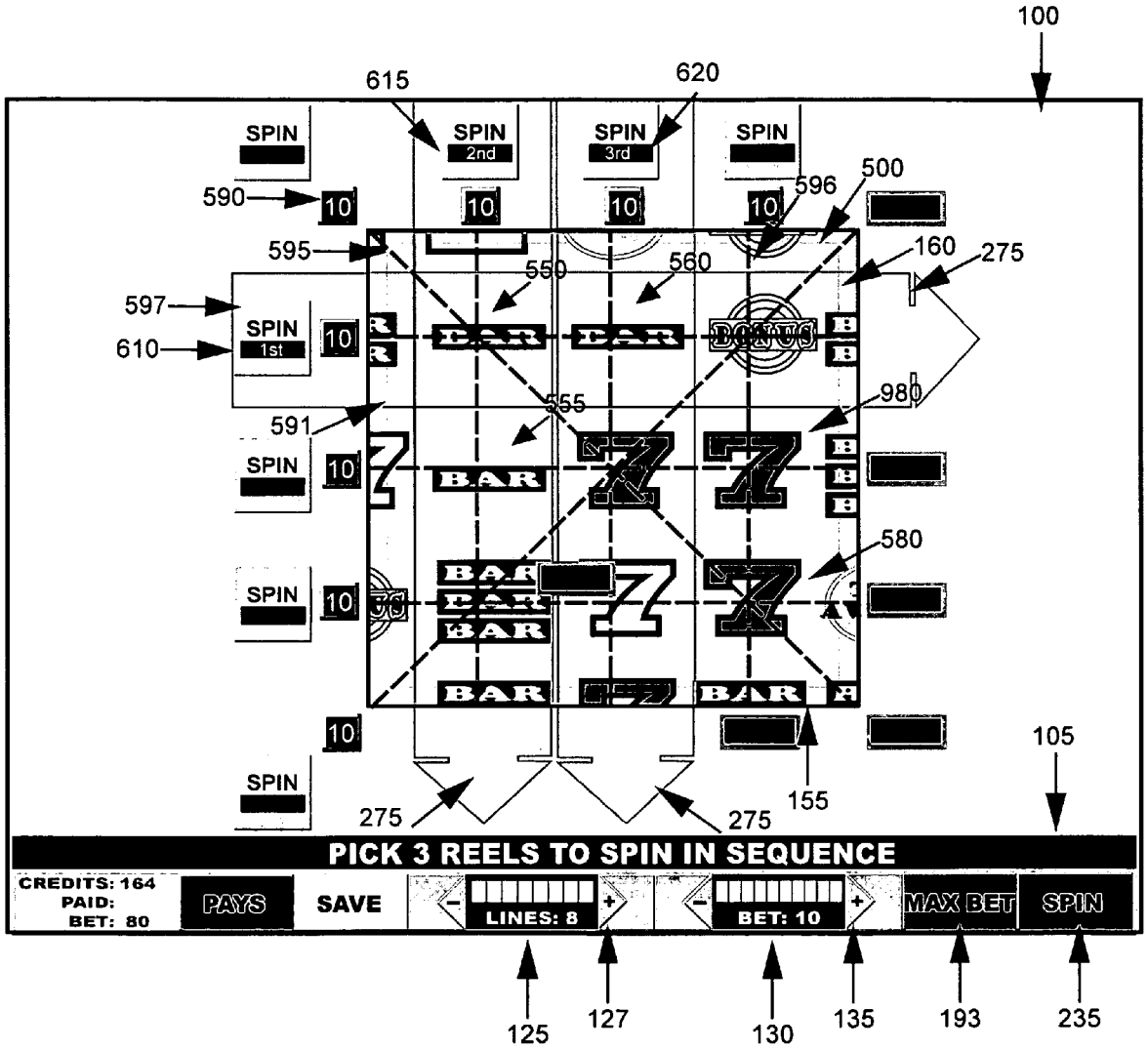
FIG. 22 shows video screen display for the electronic slot machine after the third and final display where the player has opted to continue play.

FIG. 22 shows video screen display 100 for the electronic slot machine after the third and final display of symbols 580 and 980 where the player has opted to continue play and take advantage of his last hand. Message board 105 instructs the player to "pick three reels to spin in sequence." As before, using bet selector key 130 and adjustment keys 135, the player selects the dollar amount of the bet he wishes to place on each straight line 591, 595, and 596. Next, using line selector key 125 and adjustment keys 127, the player selects the number of lines he wishes to play. Then, using line keys 590, the player selects which of the eight line options he wishes to place his wager on. Here the player has selected the "max bet" option by selecting max bet key 193. The player next selects spin key 235 to recommence the proposition.

As before individual columns 155, rows 160, and bands 500 become interactive. The player selects three spin selection keys 597 representing three columns 155, rows 160, or bands 500 to spin in sequence. As before when spin selection keys 597 are selected, each will indicate the sequence of columns 155, rows 160, and bands 500 the player wishes to spin. A "1$^{st}$" 610 represents the first selected row 550, a "2$^{nd}$" 615 represents the second sequentially selected column 555, and a "3$^{rd}$" 620 represents the third and final sequentially selected column 560. Here the player did not opt to select a band 500 to virtually spin. The player next selects spin key 235 to commence sequential spinning of the selected columns, rows, and bands 550, 555, and 560. Arrows 275 appear adjacent to selected columns, rows, or bands 550, 555, and 560 to indicate the direction of the virtual rotation along vertical, horizontal, and diagonal planes. This process may be repeated as many times as necessary until the player achieves his objectives.

Figure 23:
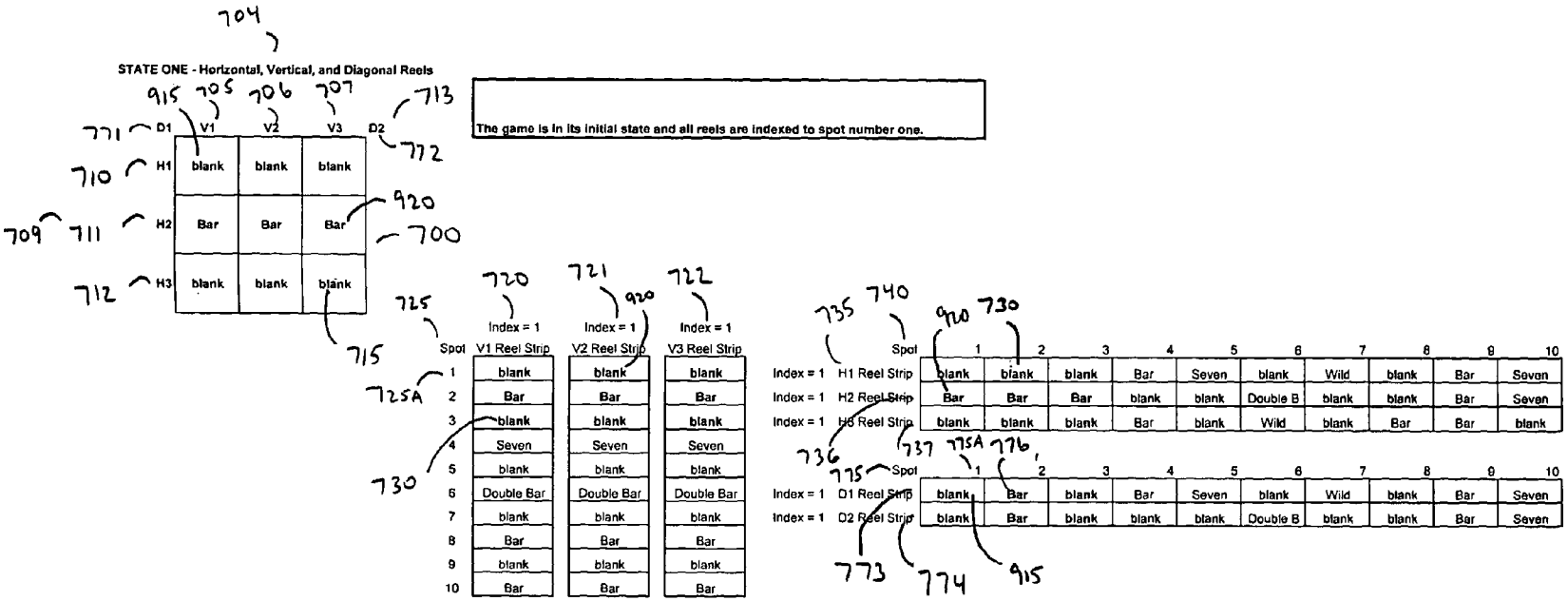
FIG. 23 is a numeric representation of an alternate embodiment of the present invention.

FIG. 23 is a numeric representation of a preferred embodiment of the present invention. Grid 700 is a numeric representation of play screen 150 in the initial stage of play, when the player first approaches the slot machine. Grid 700 is comprised of a vertical reel set 704 which comprises three vertical columns 705, 706, and 707. Grid 700 is also comprised of a horizontal reel set 709 which comprises three horizontal rows 710, 711, and 712. Grid 700 is further comprised of a diagonal reel set 713 which comprises two diagonal bands 771 and 772. Columns 705, 706, and 707, rows 710, 711, and 712 and bands 771 and 772 intersect to form a three symbol by three symbol grid 700 of at least nine symbols 715, of which five symbols 915 are shared by at least one column, one row, and one diagonal band, and of the remaining four symbols 920 are shared by at least one column and one row. Symbols 715 in grid 700 are shown as "bar(s)" and "blank(s)" but may be any character or figure created by the game designer.

Each vertical column corresponds to a vertical reel strip, so that column 705 corresponds to vertical reel strip 720, column 706 corresponds to vertical reel strip 721, and column 707 corresponds to vertical reel strip 722. Strips 720, 721, and 722 contain spots 725 that correspond to a particular symbol 730. In the preferred embodiment, strips 720, 721, and 722 contain ten spots 725. However, the present invention is in no way limited to a fixed number of spots. In fact, electronic and computer technology has enabled the game designer to create thousands or millions of spots 725 on each strip. After a random spin, symbols 915 and 920 on grid 700 are visible to the player and correlate to a random selection of three sequential spots on the corresponding strip (See FIGS. 24-26).

Each horizontal row corresponds to a horizontal reel strip, so that row 710 corresponds to horizontal reel strip 735, row 711 corresponds to horizontal reel strip 736, and row 712 corresponds to horizontal reel strip 737. Strips 735, 736, and 737 contain spots 740 that correspond to a particular symbol 730. In the preferred embodiment, strips 735, 736, and 737 contain ten spots 740. However, as before, the present invention is in no way limited to a fixed number of spots. After a random spin, symbols 915 and 920 on grid 700 are visible to the player and correlate to a random selection of three sequential spots on the corresponding strip.

Each diagonal band corresponds to a diagonal reel strip, so that band 771 corresponds to diagonal reel strip 773 and band 772 corresponds to diagonal reel strip 774. Strips 773 and 774 contain spots 775 that correspond to a particular symbol 776. In the preferred embodiment, strips 773 and 774 contain ten spots 775. However, as before, the present invention is in no way limited to a fixed number of spots. After a random spin, shared symbols 915 on grid 700, are visible to the player and correlate to a random selection of three sequential spots on the corresponding strip.

Figure 24:
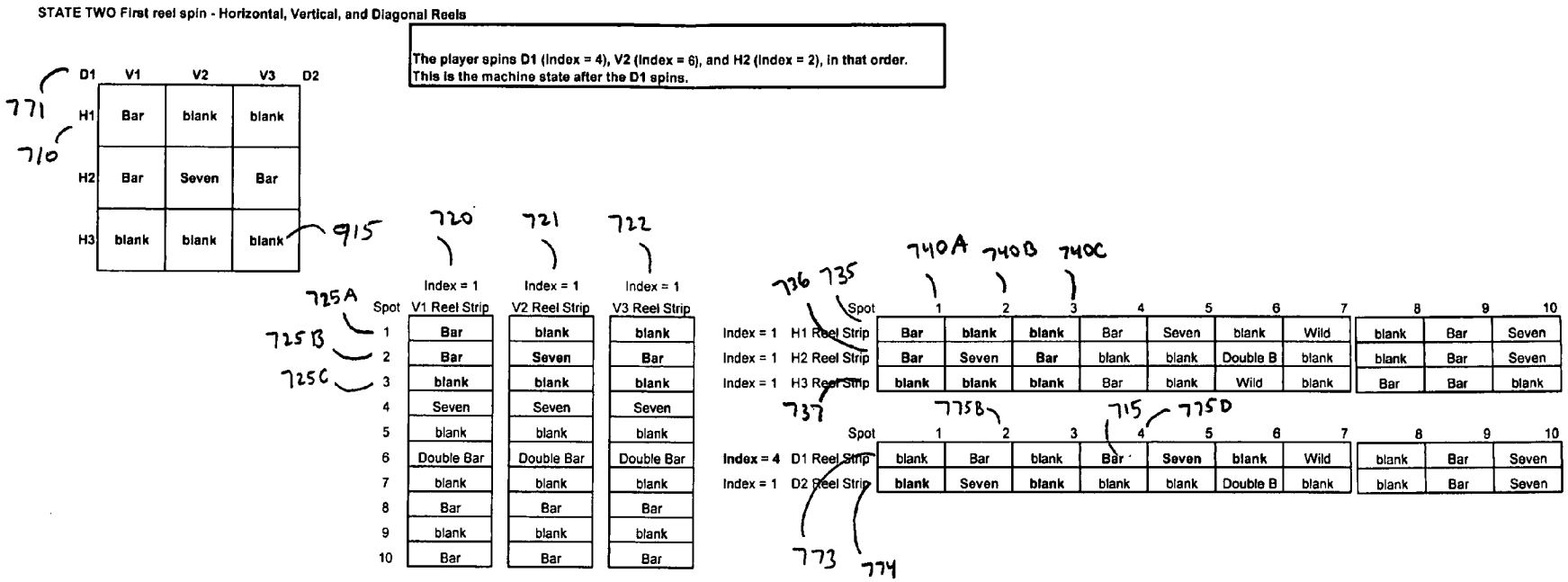
FIG. 24 is a numeric representation of an alternate embodiment of the present invention after the first diagonal band selection completed its spin.
Figure 25:
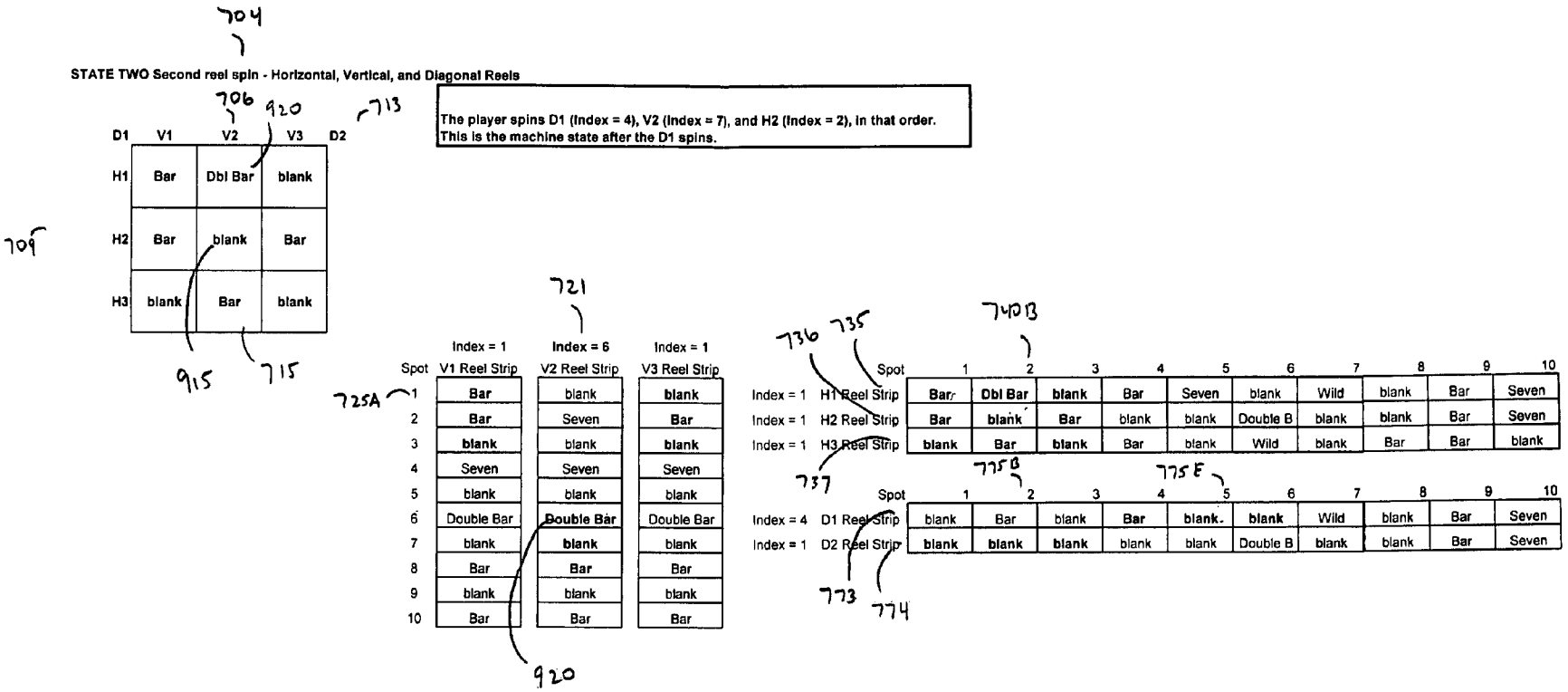
FIG. 25 is a numeric representation of an alternate embodiment of the present invention after the second vertical column selection completed its spin.
Figure 26:
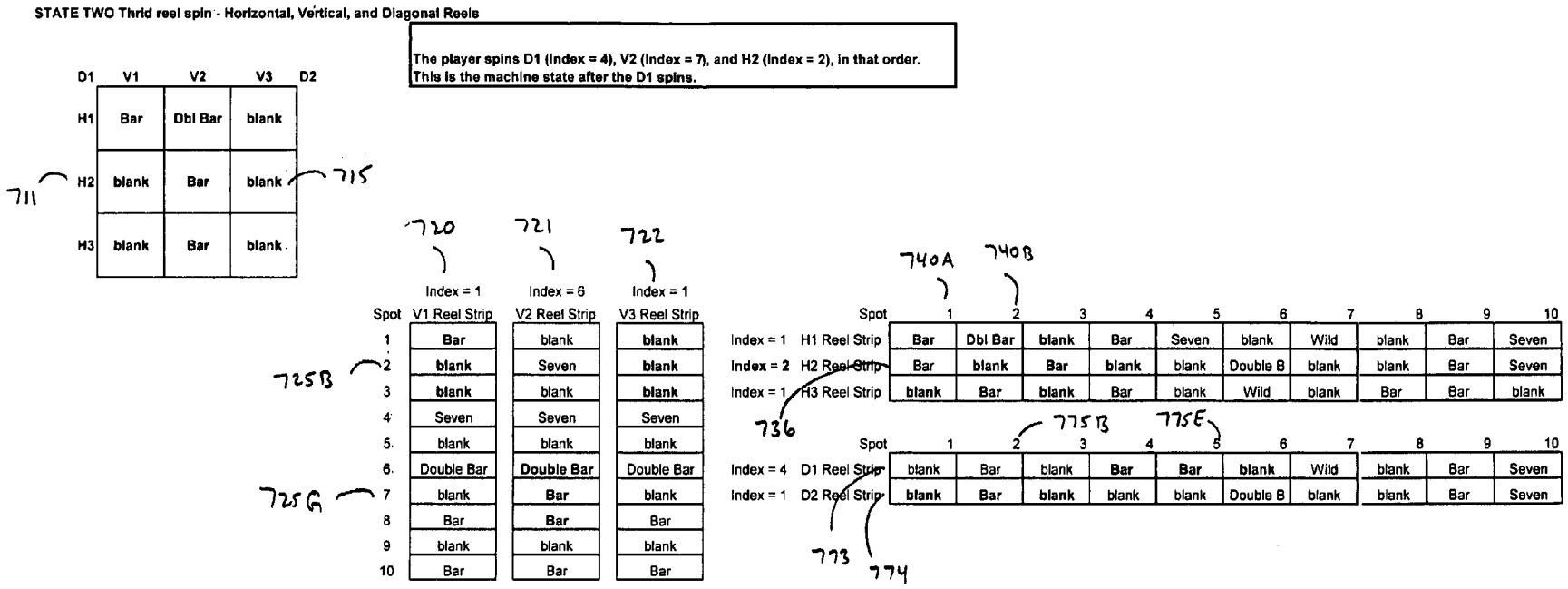
FIG. 26 is a numeric representation of a preferred embodiment of the present invention after the third and final horizontal row selection completed its spin.

FIGS. 24-27 illustrate a numerical representation of FIG. 23 once the player has sequentially selected to virtually spin band 771 (FIG. 24), followed by the second column 706 (FIG. 25), and finally the second row 711 (FIG. 26). FIG. 24 shows strip 773 after the first band 771 has completed the first sequentially selected virtual "spin" and temporarily displays a new array of symbols 915. The result of a random virtual spin of band 771 has caused the shared symbol 915 from spot one 775A in FIG. 23 to "move" to spot four 775D in FIG. 24 to become the new first shared symbol 915 in strip 773 corresponding to band 771. Incidentally, since diagonal reel set 713, vertical reel set 704 and horizontal reel set 709 intersect, this diagonal move has also caused a change of symbols on spot one 740A for horizontal strip 735, spot two 740B for horizontal strip 736, and spot three 740C for horizontal reel strip 737. This diagonal move has also caused a change of symbols on spot one 725A for vertical strip 720, on spot two 725B for vertical reel strip 721, and on spot three 725C for vertical strip 722. Finally, this diagonal move has also caused a change of symbols on spot two 775B for diagonal strip 774.

FIG. 25 shows strip 721 after the second column 706 has completed the second sequentially selected virtual "spin" and temporarily displays a new array of symbols 715. The result of a random virtual spin of strip 721 has caused symbol 920 from spot one 725A in FIG. 10 to "move" to spot six 725F in FIG. 25 to become the new first symbol 920 in strip 721 corresponding to column 706. Again, since diagonal reel set 713, vertical reel set 704 and horizontal reel set 709 intersect, this vertical move has also caused a change of symbols on spot two 740B for horizontal strips 735, 736, and 737. This vertical move has also caused a change of symbols on spot five 775E for diagonal strip 773 and spot two 725B for diagonal strip 774.

FIG. 26 shows strip 736 after the second row 711 has completed the third and final sequentially selected virtual "spin" and displays a new array of symbols 715. The result of a random virtual spin of strip 736 has caused symbol 920 from spot one 740A in FIG. 10 to "move" to spot two 740B in FIG. 26 to become the new first symbol 920 in strip 736 corresponding to row 711. Again, since diagonal reel set 713, vertical reel set 704 and horizontal reel set 709 intersect, this horizontal move has also caused a change of symbols on spot two 725B for vertical strips 720 and 722, and spot seven 725G on vertical strip 721. This vertical move has also caused a change of symbols on spot five 775E for diagonal strip 773 and spot two 725B for diagonal strip 774.

Aspects of the present invention may be implemented on one or more computers executing software instructions. According to one embodiment of the present invention, server and client computer systems transmit and receive data over a computer network or a fiber or copper-based telecommunications network. The steps of accessing, downloading, and manipulating the data, as well as other aspects of the present invention are implemented by central processing units (CPU) in the server and client computers executing sequences of instructions stored in a memory. The memory may be a random access memory (RAM), read-only memory (ROM), a persistent store, such as a mass storage device, or any combination of these devices. Execution of the sequences of instructions causes the CPU to perform steps according to embodiments of the present invention.

The instructions may be loaded into the memory of the server or client computers from a storage device or from one or more other computer systems over a network connection. For example, a client computer may transmit a sequence of instructions to the server computer in response to a message transmitted to the client over a network by the server. As the server receives the instructions over the network connection, it stores the instructions in memory. The server may store the instructions for later execution, or it may execute the instructions as they arrive over the network connection. In some cases, the CPU may directly support the downloaded instructions. In other cases, the instructions may not be directly executable by the CPU, and may instead be executed by an interpreter that interprets the instructions. In other embodiments, hardwired circuitry may be used in place of, or in combination with, software instructions to implement the present invention. Thus, the present invention is not limited to any specific combination of hardware circuitry and software, nor to any particular source for the instructions executed by the server or client computers. In some instances, the client and server functionality may be implemented on a single computer platform.

Aspects of the present invention can be used in a distributed electronic commerce application that includes a client/server network system that links one or more server computers to one or more client computers, as well as server computers to other server computers and client computers to other client computers. The client and server computers may be implemented as desktop personal computers, workstation computers, mobile computers, portable computing devices, personal digital assistant (PDA) devices, cellular telephones, digital audio or video playback devices, or any other similar type of computing device. For purposes of the following description, the terms "computer network" and "online" may be used interchangeably and do not imply a particular network embodiment or topography. In general, any type of network (e.g., LAN, WAN, or Internet) may be used to implement the online or computer networked implementation of the electronic slot machine.

Figure 27:
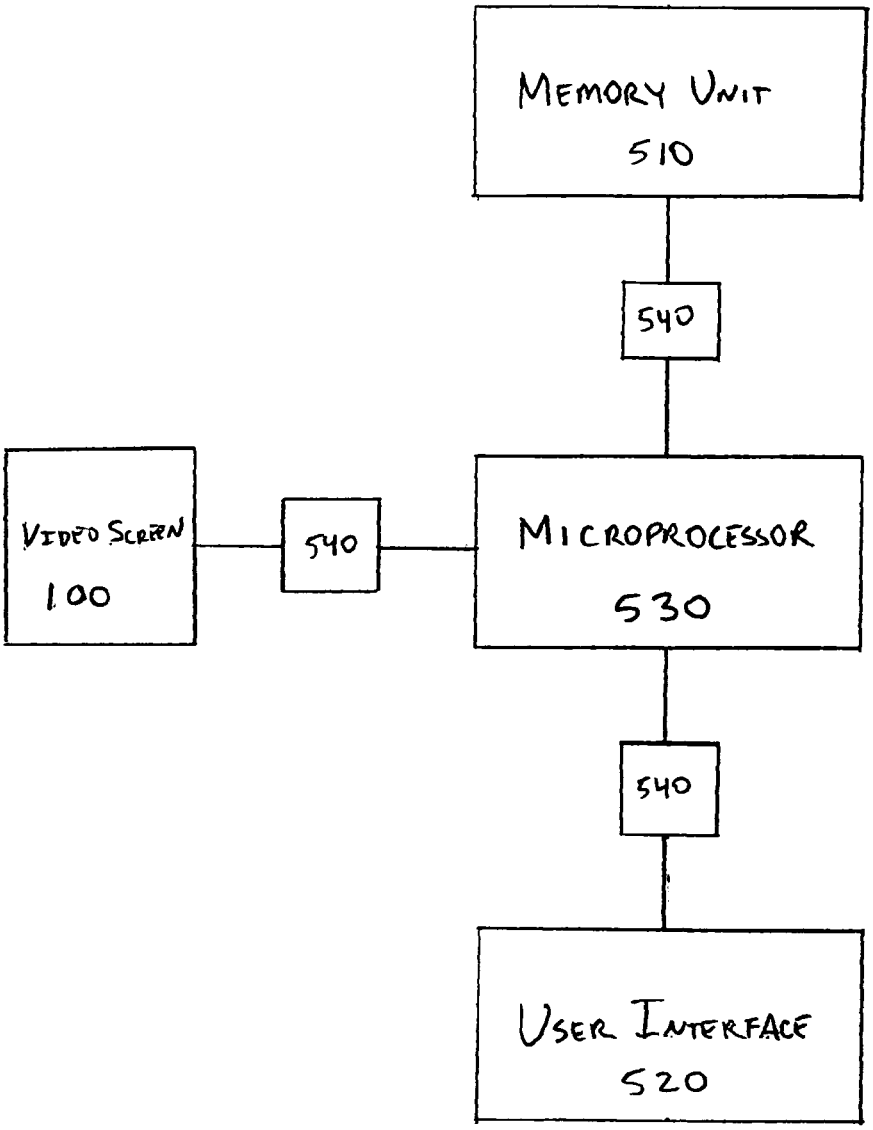
FIG. 27 is a block diagram that schematically shows the control system for the electronic slot machine of FIGS. 1 and 14.

FIG. 27 is an illustrative diagram of an embodiment of the present invention. Video screen 100 presents the user with the outcome of the last game played on the machine. This outcome is the start position for the new game. Video screen 100, includes play screen 150, columns 155, rows 160, symbols 180, and all the various keys and windows described above in FIG. 1. As explained above, video screen 100 may incorporate touch-screen technology, with a fully or partially integrated user interface 520. Screen 100 is connected to memory unit or units 510.

Memory unit 510 is connected to microprocessor 530 and stores data that has been processed by microprocessor 530. Data stored in memory unit 510 directly correlates to the symbols, reels, window, keys, and other graphics which are required to play the electronic slot machine. Although this data can be stored in many different forms, the data must translate to visual data for screen 100 in the form of symbols, reels, windows, keys and other graphic components of the electronic slot machine.

Microprocessor 530 is further connected to user interface 520. The player of the electronic slot machine utilizes user interface 520 to initiate game play. The initiation of the game occurs by the player selecting a sequence for spinning a combination of up to three columns 155 and rows 160. Once columns 155 and rows 160 are selected, the selection is sent to microprocessor 530 by computer-executable instruction 540. Microprocessor 530 then sequentially spins selected columns and rows 250, 255, and 260 as shown on screen 100. In the preferred embodiment, microprocessor 530 is directly connected to screen 100 and controls the virtual spinning of selected columns 155 and rows 160. The spinning instruction is sent as a computer-executable instruction 540 by microprocessor 530. Once the virtual spinning of sequentially selected columns 155 and rows 160 is complete, further computer-executable instruction 540 is sent from microprocessor 530 to memory unit 510 to display a random resulting set of symbols arrayed on columns 155 and rows 160. The random selection of symbols may be accomplished by programmable algorithms within microprocessor 530. There are, or course, many alternative ways to generate a random array of symbols which are known to those skilled in the art.

Microprocessor 530 then sequentially spins the second set of selected columns and rows 250, 255, and 260 as shown on screen 100 (see FIG. 5). As before, Microprocessor 530 is directly connected to screen 100 and controls the virtual spinning of selected columns 155 and rows 160. The spinning instruction is sent as a computer-executable instruction 540 by microprocessor 530. Once the virtual spinning of sequentially selected columns 155 and rows 160 is complete, further computer-executable instruction 540 is sent from microprocessor 530 to memory unit 510 to display a random resulting set of symbols arrayed on columns 155 and rows 160.

Microprocessor 530 then sequentially spins the third and final set of selected columns and rows 250, 255, and 260 as shown on screen 100 (see FIG. 7). As before, Microprocessor 530 is directly connected to screen 100 and controls the virtual spinning of selected columns 155 and rows 160. The spinning instruction is sent as a computer-executable instruction 540 by microprocessor 530. Once the virtual spinning of sequentially selected columns 155 and rows 160 is complete, further computer-executable instruction 540 is sent from microprocessor 530 to memory unit 510 to display a random resulting set of symbols arrayed on columns 155 and rows 160.

Thereafter, once a random array of symbols are displayed after the third and final sequential spin, microprocessor 530 determines whether the resulting set of symbols 180 constitute a winning combination. Finally, depending on whether the resulting set symbols 180 is a winning combination, microprocessor 530 also control the text displayed on message board 105, congratulating the player on a win, or prompting the user to "Try Again" with special light displays.

If the player wishes to continue play and build upon the results of his first spin, the player utilizes user interface 520 to initiate game play (see FIG. 9). As before, the initiation of the game occurs by the player selecting a sequence for spinning a combination of up to three columns 155 and rows 160. Once columns 155 and rows 160 are selected, the selection is sent to microprocessor 530 by computer-executable instruction 540, and sequentially elected columns rows 250, 255, and 260 are spin in the manner described above. This process continues until the player reaches his objective.

While the present invention has been described in terms of a preferred embodiment above, those skilled in the art will readily appreciate that numerous modifications, substitutions and additions may be made to the disclosed embodiment without departing from the spirit and scope of the present invention. It is intended that all such modifications, substitutions and additions fall within the scope of the present invention that is best defined by the claims below.

What is claimed is:

1. An electronic slot machine apparatus, the apparatus comprising:

a video screen;

a bill acceptor;

a processor connected to the video screen and configured to read computer readable instructions, the instructions programmed to cause the processor to:

receive cash from the bill acceptor;

display a grid comprising X columns of Y rows of symbols, the grid comprising a first row and an adjacent second row and a first column and an adjacent second column;

maintain both a horizontal reel set and a vertical reel set, the horizontal reel set intersects the vertical reel set, wherein the grid corresponds to only a subset of the horizontal reel set and the vertical reel set so that not all symbols on the horizontal reel set are displayed on the grid at once and not all symbols on the vertical reel set are displayed on the grid at once;

wherein the first row intersects both the first column and the second column and the second row intersects both the first column and the second column;

receive a first wager;

spin and stop the first column, wherein symbols on the first column that intersect with the first row and the second row move along with the first column;

award any earned payout based on the first wager based on displayed symbols;

after the spin and stop the first column, receive a second wager;

spin and stop the first row, wherein symbols on the first row that intersect with the first column and the second column move along with the first row; and award any earned payout based on the second wager based on displayed symbols, wherein at least one symbol has moved on both the horizontal reel set and the vertical reel set, wherein the spin and stop the first column and the spin and stop the first row use a random number generator to determine where to stop.

2. The apparatus as recited in claim 1, wherein the instructions are further programmed such that before the spin and stop the first column, receive a wager from a player.

3. The apparatus as recited in claim 2, wherein the instructions are further programmed to determine whether an active payline on the video screen forms a winning combination, and if so, pay an award to the player.

4. The apparatus as recited in claim 1, wherein the instructions are further programmed such that before the spin and stop the first column, a first common symbol appears on both the first column and the first row on an intersecting point between the first column and the first row, and after the spin and stop the first column the first common symbol appears on both the first column and the second row but not the first row.

5. The apparatus as recited in claim 1, wherein the instructions are further programmed such that X=5 and Y=3.

6. The apparatus as recited in claim 1, wherein the instructions are further programmed such that X=3 and Y=3.

7. The apparatus as recited in claim 1, wherein the instructions are further programmed to spin and stop the second column, wherein symbols on the second column that intersect with the first row and the second column move along with the second column.

8. The apparatus as recited in claim 1, wherein the instructions are further programmed to spin and stop the second row, wherein symbols on the second row that intersect with the first column and the second column move along with the second row.

9. The apparatus as recited in claim 1, wherein the instructions are further programmed to allow the player to select a particular row out of the displayed rows to spin.

10. The apparatus as recited in claim 1, wherein the instructions are further programmed to perform a diagonal spin which moves a particular symbol that intersects with the first column and the first row to a previously presented position that intersects with the second column and the second row.

11. The apparatus as recited in claim 1, wherein X is at least 3 and Y is at least 3.

12. A method to play a slot machine, the method comprising:

executing the following operations on an electronic processor:

crediting cash received from a bill acceptor on the slot machine;

providing and displaying a grid comprising X columns of Y rows of symbols, the grid comprising a first row and an adjacent second row and a first column and an adjacent second column;

maintaining both a horizontal reel set and a vertical reel set, the horizontal reel set intersects the vertical reel set, wherein the grid corresponds to only a subset of the horizontal reel set and the vertical reel set so that not all symbols on the horizontal reel set are displayed on the grid at once and not all symbols on the vertical reel set are displayed on the grid at once;

wherein the first row intersects both the first column and the second column and the second row intersects both the first column and the second column;

receiving a first wager;

spinning and stopping the first column, wherein symbols on the first column that intersect with the first row and the second row move along with the first column;

awarding any earned payout based on the first wager based on displayed symbols;

after the spinning and stopping the first column, receive a second wager;

spinning and stopping the first row, wherein symbols on the first row that intersect with the first column and the second column move along with the first row; and awarding any earned payout based on the second wager based on displayed symbols, wherein at least one symbol has moved on both the horizontal reel set and the vertical reel set, wherein the spinning and stopping the first column and the spinning and stopping the first row use a random number generator to determine where to stop.

13. The method as recited in claim 12, further comprising, before the spinning and stopping the first column, receiving a wager from a player.

14. The method as recited in claim 13, further comprising, determining whether an active payline forms a winning combination, and if so, paying an award to the player.

15. The method as recited in claim 12, wherein before the spinning and stopping the first column, a first common symbol appears on both the first column and the first row on an intersecting point between the first column and the first row, and after the spinning and stopping the first column the first common symbol appears on both the first column and the second row but not the first row.

16. The method as recited in claim 12, wherein X=3 and Y=3.

17. The method as recited in claim 12, wherein X=5 and Y=3.

18. The method as recited in claim 12, further comprising spinning and stopping the second column, wherein symbols on the second column that intersect with the first row and the second row move along with the second column.

19. The method as recited in claim 12, wherein X is at least 3 and Y is at least 3.

20. The method as recited in claim 12, further comprising allowing the player to select a particular row out of the displayed rows to spin.

* * * * *